US008544834B2

(12) United States Patent
Sato et al.

(10) Patent No.: US 8,544,834 B2
(45) Date of Patent: Oct. 1, 2013

(54) SHEET PROCESSING APPARATUS AND IMAGE FORMING APPARATUS

(75) Inventors: Tomoharu Sato, Abiko (JP); Yasuo Fukatsu, Abiko (JP); Hitoshi Kato, Toride (JP); Naoki Ishikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 13/195,466

(22) Filed: Aug. 1, 2011

(65) Prior Publication Data

US 2012/0028778 A1 Feb. 2, 2012

(30) Foreign Application Priority Data

Aug. 2, 2010 (JP) ..... 2010-173728
Jul. 15, 2011 (JP) ..... 2011-156464

(51) Int. Cl.
*B31F 1/00* (2006.01)

(52) U.S. Cl.
USPC ..... 270/45; 270/58.07

(58) Field of Classification Search
USPC ..... 270/32, 37, 51, 58.07; 493/406, 493/442, 454
See application file for complete search history.

(56) References Cited

U.S. PATENT DOCUMENTS

| | | | | |
|---|---|---|---|---|
| 6,692,208 | B1 | 2/2004 | Watkiss et al. | |
| 7,259,877 | B2 | 8/2007 | Inoo et al. | |
| 7,431,273 | B2 * | 10/2008 | Kamiya et al. | 270/37 |
| 7,594,645 | B2 * | 9/2009 | Suzuki et al. | 270/37 |
| 2010/0230886 | A1 * | 9/2010 | Watanabe et al. | 270/45 |

FOREIGN PATENT DOCUMENTS

| | | | |
|---|---|---|---|
| EP | 1138521 | A2 | 10/2001 |
| GB | 2360013 | A | 9/2001 |

* cited by examiner

*Primary Examiner* — Leslie A Nicholson, III
(74) *Attorney, Agent, or Firm* — Fitzpatrick, Cella, Harper & Scinto

(57) ABSTRACT

A finisher deforms a fold end portion of a sheet bundle with a lower pressing plate and an upper pressing plate. A pressing unit holds a sheet bundle so that the fold end portion is positioned between the lower pressing plate and the upper pressing plate. A third pressing roller includes a third pressing surface that presses the fold end portion of the sheet bundle between the lower pressing plate and the upper pressing plate. The third pressing roller moves in between the lower pressing plate and the upper pressing plate. The third pressing roller or the pressing unit moves so that the third pressing surface of the third pressing roller presses the fold end portion at a predetermined position based on a tip of the fold end portion. The fold end portion projects after the sheet bundle is held between the lower pressing plate and the upper pressing plate.

6 Claims, 20 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus and more particularly to a sheet processing apparatus and an image forming apparatus having the same, wherein the sheet processing apparatus folds a sheet bundle in two and deforms a fold end portion of the folded sheet bundle.

2. Description of the Related Art

A conventionally known sheet processing apparatus bundles multiple sheets having images formed thereon, staples the center of the sheets, folds the sheets, and shapes them into a booklet-shaped sheet bundle (hereafter also referred to as a booklet). The sheet processing apparatus overlays sheets having images formed thereon one by one to prepare a sheet bundle. The sheet processing apparatus then staples the center of the sheet bundle and then folds the sheet bundle by pressing the sheet bundle into a nip of folding rollers using a pressing plate.

When a sheet bundle contains many sheets (e.g., 20 sheets or more), however, the fold end portion increasingly bends from the inside of the booklet to the outside (cover) and may not be folded fully. Such a booklet, when folded, may be half opened loosely and may not be placed flat. It is difficult to stack many booklets. The sheet processing apparatus has been requested to prevent the fold end portion of a booklet from bending and to fully fold booklets.

To solve this problem, U.S. Pat. No. 6,692,208 discusses a sheet processing apparatus that squares the fold end portion of a booklet to prevent the fold end portion from bending. The sheet processing apparatus discussed in U.S. Pat. No. 6,692,208 conveys a booklet with a fold end portion thereof being the front in a conveying direction. A holding unit nips to fasten the vicinity of the fold end portion. A pressing roller presses the fold end portion projecting from the holding unit to square the fold end portion.

The sheet processing apparatus discussed in U.S. Pat. No. 6,692,208 presses the booklet fold end portion projecting from the holding unit. If a large part of the fold end portion projects, the deformed fold end portion may bulge outward at both edges and leave a press mark on both edges due to the holding unit. Such a press mark is undesirable on booklets for a cosmetic reason.

To prevent the press mark from being formed, for example, a booklet may be nipped and fastened so that the fold end portion is positioned in between the holding unit and does not project from the holding unit. The pressing roller may be inserted in between the holding unit to press the fold end portion.

However, nipping to fasten the booklet presses the booklet in a thickness direction and bulges the fold end portion. For example, normally inserting the pressing roller increases the amount of the pressed (collapsed) fold end portion when the booklet fold end portion projects toward the pressing roller. As a result, the pressing roller may deform unintended sheets (e.g., those at the center) of the booklet and degrade the aesthetic quality at the fold end portion. Decreasing the amount of pressing roller insertion may prevent the amount of the pressed (collapsed) fold end portion from increasing. However, the fold end portion may not be fully pressed if a small amount of the fold end portion is deformed. The tip position of the fold end portion varies with the amount of the fold end portion formed by the holding unit. The pressing roller causes differences in the amount of pressed (collapsed) fold end portions. As a result, fold end portions are inconsistently shaped and the fold end portion quality may degrade.

The present invention provides a sheet processing apparatus and an image forming apparatus having the same, wherein the sheet processing apparatus can prevent a fold end portion from bending and stably form the fold.

SUMMARY OF THE INVENTION

The invention relates to a sheet processing apparatus that folds a sheet bundle in two and performs a deforming process by pressing a tip at a fold end portion of the folded sheet bundle. The sheet processing apparatus includes a sheet holding portion and a pressing portion. The sheet holding portion nips to hold the folded sheet bundle. The pressing portion presses a tip at a fold end portion of the sheet bundle held by the sheet holding portion. The pressing portion or the sheet holding portion is movable based on a tip position at the fold end portion of the sheet bundle held by the sheet holding portion in a direction for the pressing portion to press a tip at the fold end portion of the sheet bundle so that a predetermined distance is ensured between a pressing position of the pressing portion and a tip position at the fold end portion of the sheet bundle held by the sheet holding portion.

According to the invention, the pressing portion or the sheet holding portion is moved to press the fold end portion at a predetermined position based on the tip position at the fold end portion of a sheet bundle. The sheet processing apparatus can prevent the fold end portion from bending and stably form the fold.

Further features of the present invention will become apparent from the following description of exemplary embodiments with reference to the attached drawings.

DESCRIPTION OF THE EMBODIMENTS

A sheet processing apparatus and an image forming apparatus according to an embodiment of the present invention will be described with reference to drawings. The image forming apparatus includes a finisher 500 as the sheet processing apparatus that folds sheets inside and forms a booklet-shaped sheet bundle. The sheet processing apparatus represents a copier, a printer, a facsimile machine, and a multifunctional machine combining the functions thereof. The embodiment will be described using a copier 1000 as the image forming apparatus.

Figure 1:
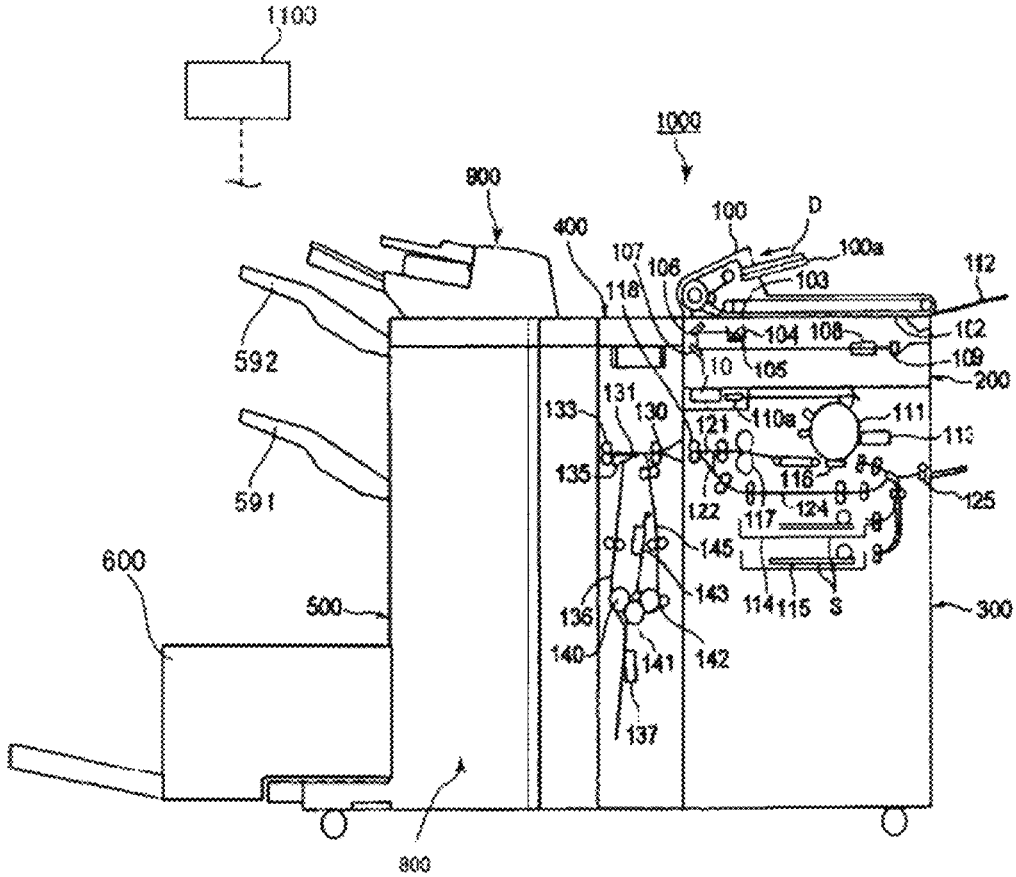
FIG. 1 is a sectional view schematically illustrating the overall structure of a copier according to an embodiment of the invention.

The following describes an overall configuration of the copier 1000 according to the embodiment of the invention with reference to FIG. 1. FIG. 1 is a sectional view schematically illustrating the overall structure of the copier 1000 according to an embodiment of the invention. As illustrated in FIG. 1, the copier 1000 includes a document feeding portion 100, an image reading portion 200, and a printing portion 300 as an image forming portion. The copier 1000 also includes a folding processing portion 400, an inserter 900, the finisher 500, a controlling portion 1100, and an operation portion 1 (not illustrated in FIG. 1).

The document feeding portion 100 feeds documents D one by one to an image reading position (not illustrated) of the image reading portion 200. The image reading portion 200 reads an image on the document D. The printing portion 300 forms an image on a sheet S based on image information that is read by the image reading portion 200 from the document D or is supplied otherwise. The folding processing portion 400 performs a folding process such as Z-shaped folding on the sheet S before the sheet S is conveyed to the finisher 500.

The inserter 900 feeds sheets mounted by a user on insert trays 901 and 902 to stack trays 591 and 592 via the finisher 500 or to a saddle stitch binding portion 800 (to be described) of the finisher 500. Sheets stacked on the insert trays 901 and 902 are separated one by one and are merged with each other on the finisher 500 at desired timing.

The finisher 500 takes in sheets S conveyed from the folding processing portion 400 or sheets conveyed from the inserter 900. The sheet S contains an image formed by the printing portion 300. The finisher 500 then aligns the taken sheets S and binds them as one sheet bundle. The finisher 500 selectively performs a binding process to bind the rear end of a sheet bundle, a punching process to punch the rear end, a sort process, a non-sort process, and a saddle stitch binding process (including a folding process and a fold end portion deforming process) as needed.

Figure 2:
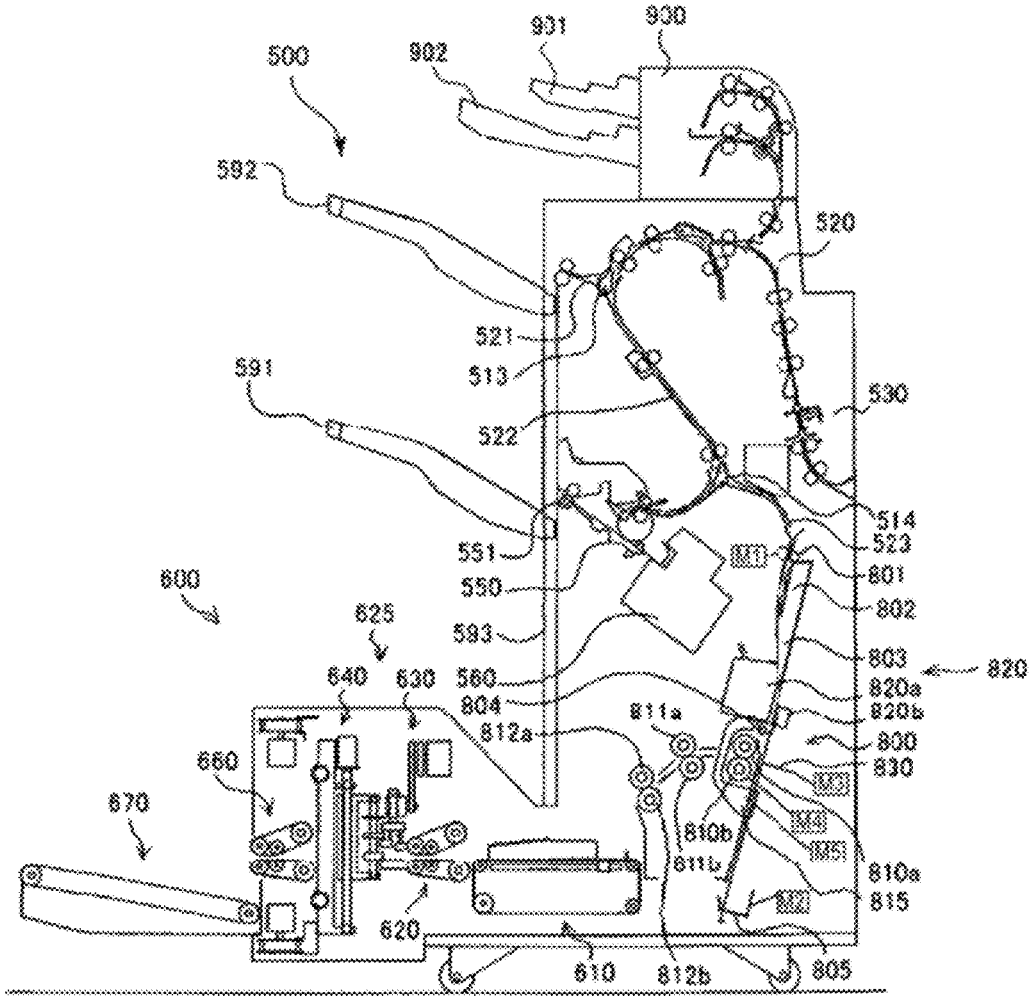
FIG. 2 is a sectional view schematically illustrating a finisher according to the embodiment.

The following describes an image forming process on the copier 1000 along the movement of the document D and the sheet S with reference to FIG. 2 as well as FIG. 1. FIG. 2 is a sectional view schematically illustrating the finisher 500 according to the embodiment. In FIG. 1, the document D is placed on a tray 100*a* of the document feeding portion 100 so as to be upright and face-up (image-formed side faced upward) viewed from a user. The binding position for the document D corresponds to the beginning of a conveying direction for the document D.

The document feeding portion 100 conveys documents D placed on the tray 100*a* one by one from the first page so that the binding position becomes the beginning end (direction of an arrow in FIG. 1). The document D is conveyed on a platen glass 102 through a curved path and is discharged to a discharge tray 112. At this time, a scanner unit 104 stays at a predetermined position. The document D is read when the document D passes over the scanner unit 104 (flow scan). A lamp 103 of the scanner unit 104 lights the document D when the document D passes over the platen glass 102. Reflected light from the document D is guided to an image sensor 109 via mirrors 105, 106, and 107, and a lens 108.

The document D conveyed by the document feeding portion 100 may be once stopped on the platen glass 102 and may be scanned by moving the scanner unit 104 (fixed scan). During fixed scan, a user lifts the document feeding portion 100 and places the document D on the platen glass 102.

The image sensor 109 reads image data from the document D, applies a predetermined image process to the image data, and transmits the data to an exposure controlling portion 110. The exposure controlling portion 110 outputs laser light corresponding to an image signal. A polygon mirror 110*a* scans and irradiates the laser light onto a photosensitive drum 111. An electrostatic latent image is formed on the photosensitive drum 111 according to the scanned laser light. A development device 113 develops the electrostatic latent image formed on the photosensitive drum 111. The developed image is visualized as a toner image. The sheet S is conveyed to a transfer portion 116 from any of cassettes 114 and 115, a manual sheet feeding portion 125, and a duplex conveying path 124. The transfer portion 116 transfers the visualized toner image. A fixing portion 117 applies a fixing process to the transferred sheet S.

After the sheet S passes through the fixing portion 117, a switching member 121 guides the sheet S to a path 122. The sheet S is switched back when a rear end thereof passes through the switching member 121 and is conveyed to a discharge roller 118. The discharge roller 118 discharges the sheet S from the printing portion 300. The sheet S is discharged from the printing portion 300 (inversed discharge) so that a side of the sheet S containing a toner image formed thereon is oriented downward (face-down).

To form an image on both sides of the sheet S, the sheet S is straight guided toward the discharge roller 118 from the fixing portion 177 and is switched back immediately after the rear end of the sheet S passes through the switching member 121. The switching member 121 then guides the sheet S to the duplex conveying path.

After discharged from the printing portion 300, the sheet S is conveyed to the folding processing portion 400. The folding processing portion 400 includes a conveying path 131 that guides the sheet S discharged from the printing portion 300 inside and guides the sheet S to the finisher 500. The conveying path 131 is provided with a pair of conveying rollers 130 and 133. A switching member 135 is provided near the pair of conveying rollers 133 and guides the sheet S conveyed from the pair of conveying rollers 130 to a folding path 136 or the finisher 500.

To perform a folding process on the sheet S, the switching member 135 is switched to the folding path 136 to guide the sheet S to the folding path 136. The sheet S guided through the folding path 136 is conveyed to folding rollers 140, 141, and 142, and is folded into a Z shape. To omit the folding process, the switching member 135 is switched to the finisher 500. The sheet S discharged from the printing portion 300 is directly conveyed through the conveying path 131. The sheet S conveyed through the folding path 136 forms a loop when the tip of the sheet S is pushed against a stopper 137. The folding rollers 140 and 141 fold down the loop. The sheet S is pushed against an upper stopper 143 to form a loop. The folding rollers 141 and 142 further fold down the loop to fold the sheet S into a Z shape. The Z-shaped folded sheet S is conveyed to the conveying path 131 through a conveying path 145. The pair of conveying rollers 133 conveys the sheet S to the finisher 500 provided downstream. The folding processing portion 400 selectively performs the folding process.

As illustrated in FIG. 2, the finisher 500 includes a conveying path 520 that guides the sheet S conveyed from the folding processing portion 400 or the inserter 900 inside the finisher 500. The conveying path 520 is provided with pairs of conveying rollers and a punch unit 530. The pairs of conveying rollers convey the sheet S conveyed from the folding processing portion 400 or the inserter 900. The punch unit 530 performs a punching process on the rear end of the conveyed sheet S as needed.

The end of the conveying path 520 branches into two. One is connected to an upper discharge path 521. The other is connected to a lower discharge path 522. A switching member 513 is provided at a branch point of the conveying path 520. The switching member 513 switches the conveying path for the sheet S to the upper discharge path 521 or the lower discharge path 522. The upper discharge path 521 is provided with a pair of upper discharge rollers that discharges the sheet S to the stack tray 592. The lower discharge path 522 is provided with a pair of conveying rollers that discharges the sheet S to the processing tray 550 or a saddle discharge path 523.

The lower discharge path 522 is connected to the other branch of the conveying path 520 and the end of the lower discharge path 522 branches into two. One is connected to the processing tray 550. The other is connected to the saddle discharge path 523. A switching member 514 is provided at a branch point of the conveying path 522. The switching member 514 switches the conveying path for the sheet S to the processing tray 550 and the saddle discharge path 523.

The switching member 514 allows the lower discharge path 522 to discharge the sheet S to the processing tray 550 where the sheets S are sequentially aligned and bundled. The sheets S are sorted or bound according to settings from the operation portion 1. A stapler 560 performs a binding process. The stapler 560 can move in a width direction of the sheet S orthogonal to the conveying direction for the sheet S and performs the binding process at any position of the sheet bundle.

A pair of bundle discharge rollers 551 selectively discharges the bundled sheet S to a stack tray 591 or 592. The stack trays 591 and 592 can move vertically. The upper stack tray 592 receives the sheet S from the upper discharge path 521 and the processing tray 550. The lower stack tray 591 receives the sheet S from the processing tray 550. The stack trays 591 and 592 store a large amount of sheets S or sheet bundles. A vertically extending rear end guide regulates the rear end of the stored sheets S or sheet bundles so as to be aligned.

The switching member 514 allows the lower discharge path 522 to discharge the sheet S to the saddle discharge path 523 through which the sheets S are conveyed to the saddle stitch binding portion 800. The saddle stitch binding portion 800 selectively performs a binding process on a sheet bundle of multiple sheets S and then performs a folding process to produce a booklet-shaped sheet bundle. The saddle stitch binding portion 800 includes a pair of saddle inlet rollers 801, a switching member 802, an accommodation guide 803, a slip roller 804, a sheet positioning member 805, a motor M1, a stapler 820, and a motor M2.

The sheet S conveyed to the saddle stitch binding portion 800 is passed to the pair of saddle inlet rollers 801. The switching member 802 operates on a solenoid according to sheet sizes and selects a carry-in port. The sheet S corresponding to the selected carry-in port is conveyed to the accommodation guide 803. The sheet S is conveyed until the slip roller 804 allows the tip to contact the movable sheet positioning member 805. The motor M1 drives the pair of saddle inlet rollers 801 and the slip roller 804. The conveyed sheets S are arranged into a sheet bundle.

The stapler 820 is provided perpendicularly to the accommodation guide 803 at the middle thereof. The stapler 820 includes a driver 820*a* to project a needle and an anvil 820*b* to bend a projected needle. The sheet positioning member 805 stops the conveyed sheet (sheet bundle) at sheet conveyance so that the center of the sheet conveying direction corresponds to the binding position of the stapler 820. The sheet positioning member 805 is movable in response to a driving force of the motor M2 and changes the positions thereof according to sizes of the sheet S.

The saddle stitch binding portion 800 includes a pair of folding rollers 810*a* and 810*b*, a projecting member 830, a motor M3, a motor M4, a pair of aligning plates 815, and a motor M5. The pair of folding rollers 810*a* and 810*b* is provided downstream of the staple 820. The projecting member 830 is provided so as to face the pair of folding rollers 810*a* and 810*b*. The projecting member 830 retracts from the accommodation guide 803 to a home position of the projecting member 830. The motor M3 drives to project the projecting member 830 toward the stored sheet bundle. The sheet bundle is then pushed into a nip between the pair of folding rollers 810*a* and 810*b* driven by the motor M4.

The sheet bundle is folded when the projecting member 830 pushes the sheet bundle into the nip between the pair of folding rollers 810*a* and 810*b*. The sheet bundle is shaped into a booklet (hereafter also referred to as a booklet T) having a fold end portion formed at the tip in the conveying direction. In other words, the pair of folding rollers 810*a* and 810*b* performs a folding process on the sheet bundle. The projecting member 830 then returns to the home position of the projecting member 830. The pair of folding rollers 810*a* and the pair of folding rollers 810*b* are provided so as to generate a pressure large enough to fold the sheet bundle. According to the embodiment, a spring (not illustrated) generates this pressure.

The folding process is performed after completion of the binding process on the sheet bundle where the stapler 820 performed the binding process. The sheet positioning member 805 is lowered for a predetermined distance from the position for the binding process so that the stapling position of the sheet bundle corresponds to the nip position of the pair of folding rollers 810. Then, the folding process is performed. The sheet bundle can be folded at the position where the binding process is performed.

The pair of aligning plates 815 has a surface that aligns sheets accommodated in the accommodation guide 803, sandwiches outer peripheral surfaces of the pairs of folding rollers 810*a* and 810*b*, and projects toward the accommodation guide 803. The pair of aligning plates 815, driven by the motor M5, moves in the direction of inserting sheets and positions the sheets in the width direction.

The saddle stitch binding portion 800 further includes first pairs of folding conveying rollers 811*a* and 811*b*, second pairs of folding conveying rollers 812*a* and 812*b*, and a deforming processing portion 600. The first pairs of folding conveying rollers 811*a* and 811*b* and the second pairs of folding conveying rollers 812*a* and 812*b* convey the folded booklet to the deforming processing portion 600. The first pair of folding conveying rollers 811 and the second pair of folding conveying rollers 812 are provided so as to generate a pressure large enough to convey and stop the folded booklet. The motor M4 rotates a pair of folding rollers 810, a first pair of folding conveying rollers 811, and a second pair of folding conveying rollers 812 at an equal speed. The deforming processing portion 600 performs a deforming process of pressing the fold end portion of the booklet conveyed from the first pair of folding conveying rollers 811 and the second pair of folding conveying rollers 812 and conveys the finished booklet to the outside.

Figure 3:
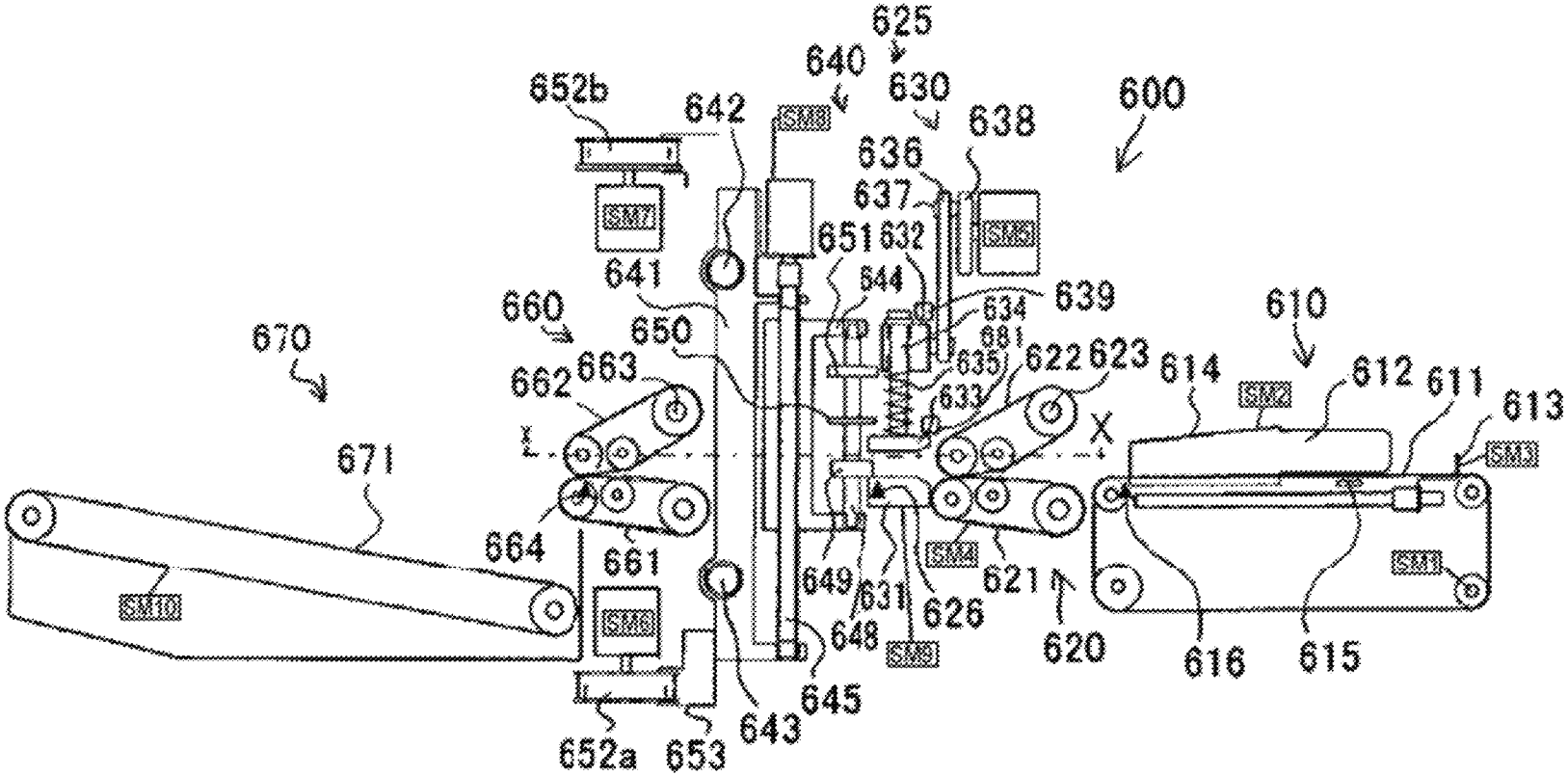
FIG. 3 is a sectional view schematically illustrating a deforming processing portion according to the embodiment.
Figure 4:
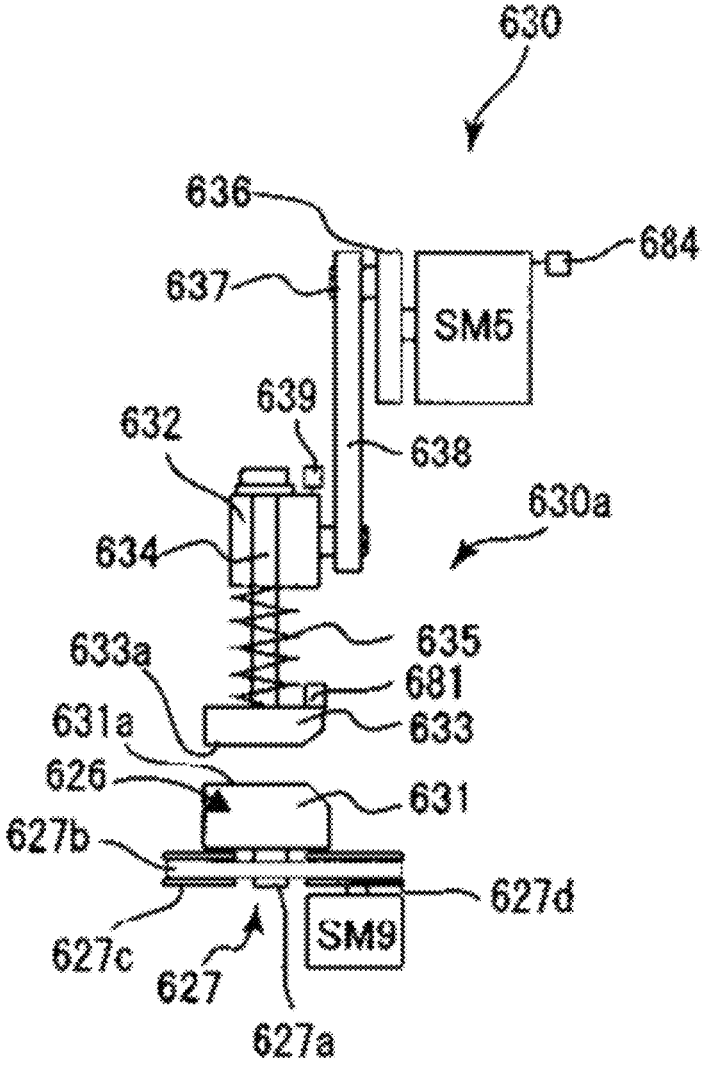
FIG. 4 illustrates a pressing unit and a pressing unit driving portion according to the embodiment.
Figure 5:
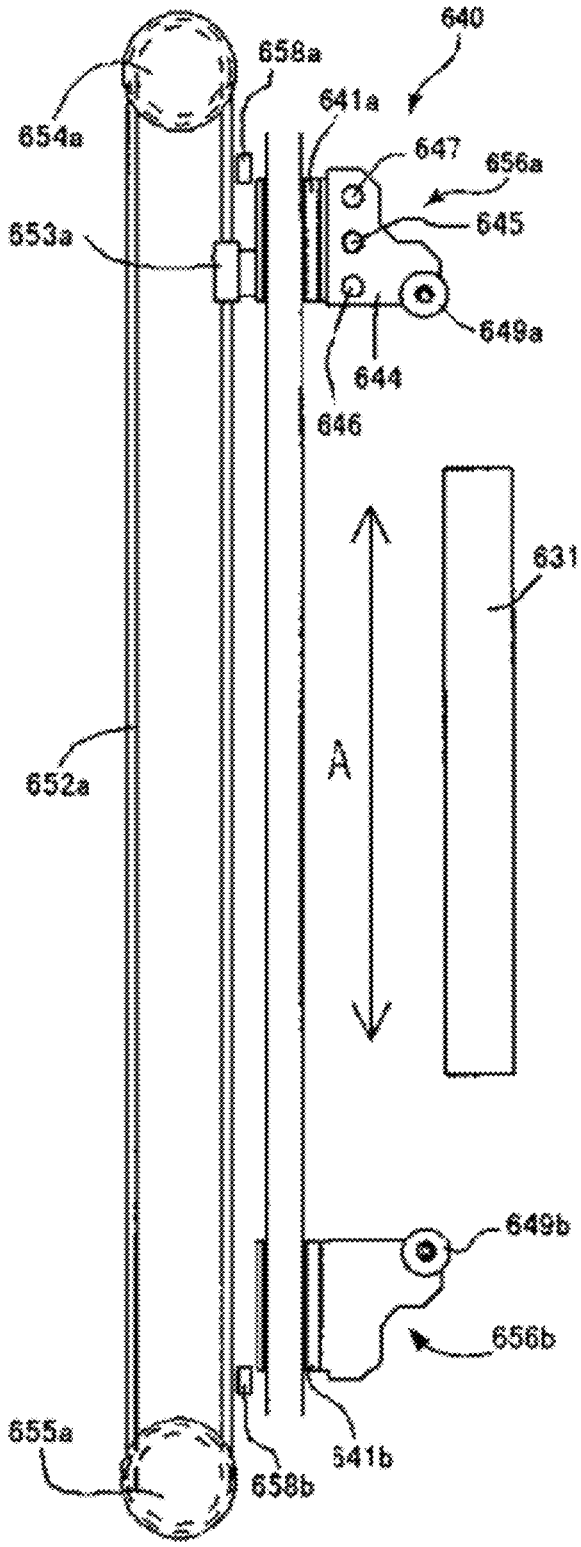
FIG. 5 is a cross sectional view of the deforming processing portion taken along the line X-X of FIG. 3.
Figure 6:
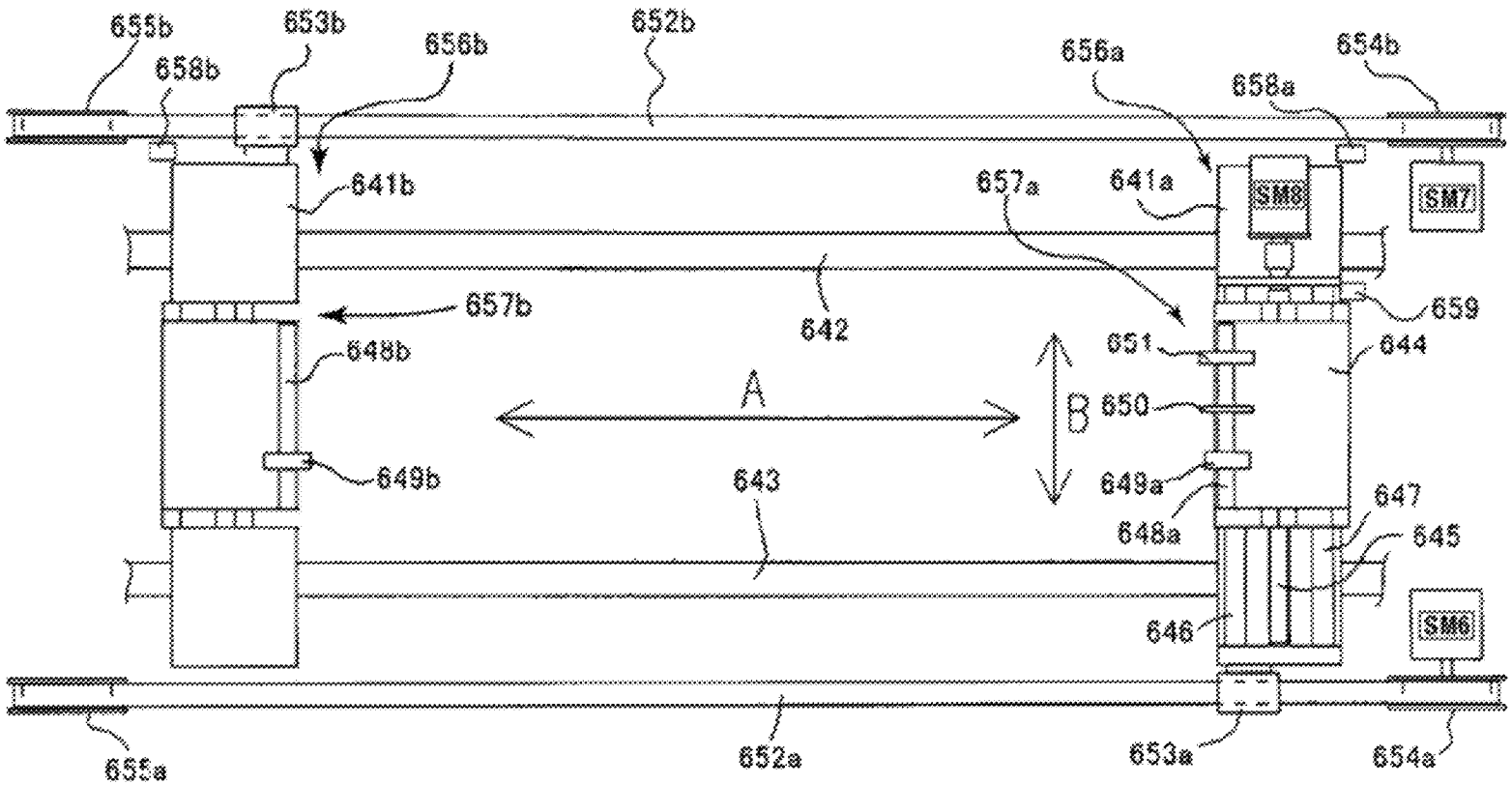
FIG. 6 is a side view of the deforming processing portion in FIG. 3 viewed from an inlet conveying portion.
Figure 7A:
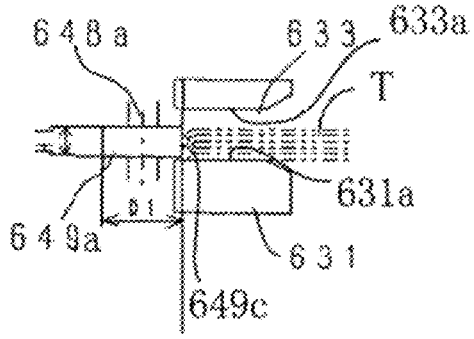
FIGS. 7A and 7B illustrate positioning by a positioning roller.
Figure 7B:
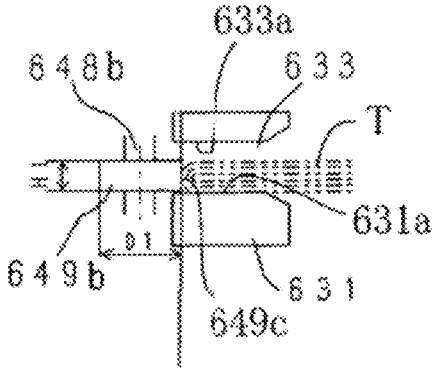
Figure 7C:
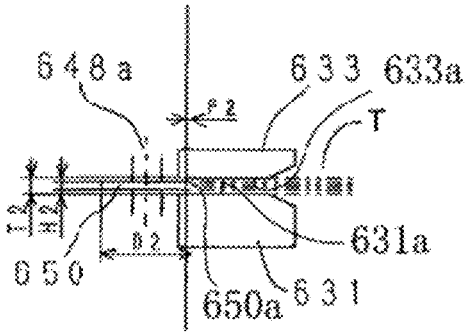
FIGS. 7C and 7D illustrate a deforming process by a first pressing roller.
Figure 7D:
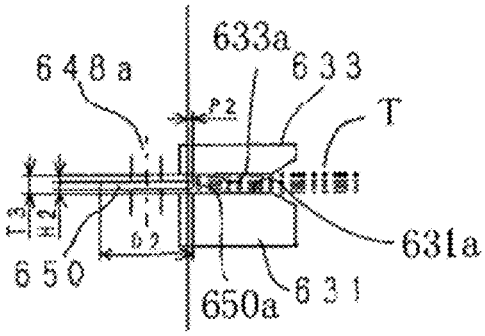

The following more specifically describes the deforming processing portion 600 with reference to FIGS. 3 through 7D as well as FIG. 2. FIG. 3 is a sectional view schematically illustrating the deforming processing portion 600 according to the embodiment. FIG. 4 illustrates a pressing unit 630 and a pressing unit driving portion 627 according to the embodiment. FIG. 5 is a cross sectional view of a deforming processing portion 640 taken along the line X-X of FIG. 3. FIG. 6 is a side view of the deforming processing portion 640 in FIG. 3 viewed from an inlet conveying portion 620. FIGS. 7A and 7B illustrate positioning by a positioning roller 649*a*. FIGS. 7C and 7D illustrate a deforming process by a first pressing roller 650. FIGS. 7E and 7F illustrate a deforming process by a second pressing roller 651.

As illustrated in FIG. 2, the deforming processing portion 600 is provided downstream of the saddle stitch binding portion 800. The deforming processing portion 600 includes a booklet receiving portion 610, an inlet conveying portion 620, a deforming process executing portion 625, an outlet conveying portion 660, and a conveyor tray 670.

As illustrated in FIG. 3, the booklet receiving portion 610 receives the booklet conveyed from the second pairs of folding conveying rollers 812*a* and 812*b* and conveys the booklet to the inlet conveying portion 620. The booklet receiving portion 610 includes a lower conveying belt 611, a pair of side guides 612, a transport claw 613, and a press guide 614. The booklet receiving portion 610 includes an inlet detecting sensor 615, an outlet detecting sensor 616, a conveying belt driving motor SM1, a side guide driving motor SM2, and a transport claw driving motor SM3.

The booklet placed on the belt rotates so as to move to the inlet conveying portion 620. The lower conveying belt 611 receives the booklet conveyed from the second pairs of folding conveying rollers 812*a* and 812*b* on the rotating belt and conveys the booklet. The lower conveying belt 611 can convey the booklet without changing the orientation thereof while receiving and conveying the booklet. The pair of side guides 612 is provided on both sides of the lower conveying belt 611 and regulates a direction (hereafter also referred to as a width direction) perpendicular to the conveying direction for the booklet. The transport claw 613 is provided at the rear end of the lower conveying belt 611 upstream in the conveying direction. The transport claw 613 touches the rear end of the booklet (upstream end of the conveying direction) and moves the booklet in the conveying direction if the booklet slips through the lower conveying belt 611. The press guide 614 is provided opposite (above) the lower conveying belt 611 and abuts the booklet surface to prevent the conveyed booklet from opening.

The inlet detecting sensor 615 detects the booklet placed on the lower conveying belt 611. The outlet detecting sensor 616 detects the booklet placed at the outlet of the booklet receiving portion 610. The conveying belt driving motor SM1 drives the lower conveying belt 611. The side guide driving motor SM2 drives the pair of side guides 612. The transport claw driving motor SM3 drives the transport claw 613.

The inlet conveying portion 620 conveys the booklet conveyed from the booklet receiving portion 610 to the deforming process executing portion 625. The inlet conveying portion 620 includes a lower conveying belt portion 621, an upper conveying belt portion 622, a rotary shaft 623, and a conveying driving motor SM4. A spring (not illustrated) presses the lower conveying belt portion 621 against the upper conveying belt portion 622. The upper conveying belt portion 622 is rotatable around the rotary shaft 623 toward the lower conveying belt portion 621. The conveying driving motor SM4 drives the lower conveying belt portion 621 and the upper conveying belt portion 622.

The deforming process executing portion 625 deforms the booklet conveyed from the inlet conveying portion 620. The deforming process executing portion 625 includes a pressing unit 630 as a sheet holding portion to hold both surfaces of the booklet, a pressing unit driving portion 627 as a moving mechanism, and a deforming unit 640 that positions the booklet and squares the fold end portion of the booklet.

As illustrated in FIG. 4, the pressing unit 630 includes a lower pressing plate 631 as a first holding portion and an upper unit 630*a* that is movable vertically (thickness direction of the booklet). The lower pressing plate 631 includes a first holding surface 631*a* and a tip detecting sensor 626 as a tip detecting portion. The first holding surface 631*a* abuts one surface of the booklet to hold the booklet from one side (see FIGS. 7A through 7F). The tip detecting sensor 626 is attached to a frame of the deforming processing portion 600. The tip detecting sensor 626 detects the tip position of the booklet fold end portion so that the fold end portion of the conveyed booklet is positioned between the lower pressing plate 631 and an upper pressing plate 633 to be described. The tip detecting sensor 626 detects the tip position of the fold end portion that is held between the lower pressing plate 631 and the upper pressing plate 633 and is projected.

The upper unit 630*a* includes a pressing unit driving motor SM5, links 636, 637, and 638, a pressing base 632, an upper pressing plate 633 as a second holding portion, and a slide connection member 634. The upper unit 630*a* includes a top dead center detecting sensor 639, a rotary encoder sensor 684, and a booklet thickness detecting sensor 681 as a sheet thickness detecting portion. The pressing base 632 is connected to the pressing unit driving motor SM5 through the links 636, 637, and 638. The pressing unit driving motor SM5 drives to vertically move the pressing base 632.

The upper pressing plate 633 is connected to the pressing base 632 through the slide connection member 634 that is slidably supported by the pressing base 632. The upper pressing plate 633 includes a second holding surface 633*a*. The second holding surface 633*a* abuts the other surface of the booklet to hold the booklet from the other side (see FIGS. 7A through 7F). A compression spring 635 is provided over the outer peripheral surface of the slide connection member 634. The compression spring 635 applies a force from the pressing base 632 to the upper pressing plate 633.

The upper pressing plate 633 presses the booklet from the other side when the pressing unit driving motor SM5 lowers the pressing base 632, the compression spring 635 is compressed or extended according to the booklet thickness, and the slide connection member 634 slides the pressing base 632. The booklet is held between the lower pressing plate 631 and the upper pressing plate 633. The top dead center detecting sensor 639 detects that the pressing base 632 stays at an upper position. The rotary encoder sensor 684 detects a rotating speed of the pressing unit driving motor SM5. A travel distance of the upper pressing plate 633 is detected from the rotating speed detected by the rotary encoder sensor 684. The booklet thickness detecting sensor 681 detects the booklet thickness by detecting the position of the upper pressing plate 633 when the booklet is fixed.

The pressing unit driving portion 627 moves the pressing unit 630 approximately parallel to the booklet conveying direction based on the booklet tip position projecting in the conveying direction after the booklet is held between the lower pressing plate 631 and the upper pressing plate 633. Specifically, the pressing unit driving portion 627 moves the pressing unit 630 so as to uniformly collapse the booklet. Accordingly, the booklet tip is pressed at a predetermined position corresponding to a predetermined distance from the projecting booklet tip position in the conveying direction.

The pressing unit driving portion 627 includes a connection member 627*a*, a timing belt 627*b*, pulleys 627*c* and 627*d*, and a pressing unit moving motor SM9 as a sheet moving portion. The pressing unit moving motor SM9 is connected to the timing belt 627*b* extending parallel to the booklet conveying direction through the pulleys 627*c* and 627*d*. The timing belt 627*b* is connected to the connection member 627*a*. The connection member 627*a* is connected to the pressing unit 630. The pressing unit moving motor SM9 drives to move the pressing unit 630 parallel to the booklet conveying direction so as to enter or retract from a gap between the lower pressing plate 631 and the upper pressing plate 633.

As illustrated in FIGS. 5 and 6, the deforming unit 640 includes slide shafts 642 and 643 supported by a frame (not illustrated), a first moving unit 656*a* to position and deform a booklet, and a second moving unit 656*b* to position the booklet. The slide shafts 642 and 643 movably support the first moving unit 656*a* and the second moving unit 656*b* along a direction A (hereafter also referred to as first direction A) as illustrated in FIGS. 5 and 6.

The first moving unit 656*a* includes a roller selection unit 657*a*, a connection member 653*a*, a timing belt 652*a*, pulleys 654*a* and 655*a*, a deformation driving motor SM6, a moving base 641*a*, and slide shafts 646 and 647. The roller selection unit 657*a* is connected to the timing belt 652*a* extending along the first direction A through the connection member 653*a*. The timing belt 652*a* is connected to the deformation driving motor SM6 through the pulleys 654*a* and 655*a*. The deformation driving motor SM6 drives to move the roller selection unit 657*a* along the first direction A. The first moving unit 656*a* includes a reference position detecting sensor 658*a*. The reference position detecting sensor 658*a* detects a reference position for movement along the first direction A.

The roller selection unit 657 is supported on the moving base 641*a* and is slidably supported on the slide shafts 646 and 647 extending along a direction B in FIG. 6. The direction B is orthogonal to the first direction X and is hereafter also referred to as the second direction B. The roller selection unit 657*a* includes a slide screw 645 extending along the second direction B and a roller selection driving motor SM8. The slide screw 645 is connected to the roller selection driving motor SM8.

The roller selection unit 657*a* includes a switching base 644, a support shaft 648*a* extending along the second direction B, a positioning roller 649*a*, a first pressing roller 650 as a pressing portion, a second pressing roller 651 as a pressing portion, and a reference position detecting sensor 659. The switching base 644 is movably supported on the moving base 641*a* through the slide screw 645. The support shaft 648*a* is rotatably supported on the switching base 644. The positioning roller 649*a*, the first pressing roller 650, and the second pressing roller 651 are fixed to the support shaft 648*a*. The roller selection driving motor SM8 drives to rotate the slide screw 645. The switching base 644 accordingly moves in the second direction B along the slide shafts 646 and 647.

The positioning roller 649*a* works in conjunction with the positioning roller 649*b* (to be described in detail) and places the booklet T at a position where the booklet T is to be deformed. As illustrated in FIG. 7A, the positioning roller 649*a* has a diameter of D1. The positioning roller 649*a* enters between the lower pressing plate 631 and the upper pressing plate 633 and positions the booklet T so that the fold end portion of the booklet T is positioned between the lower pressing plate 631 and the upper pressing plate 633. The positioning roller 649*a* has a positioning surface 649*c*. The positioning surface 649*c* is placed against the fold end portion of the booklet T to position the booklet T so that the booklet T does not project from the downstream end in the conveying direction. The positioning roller 649*a* has a width of H1 and is larger than the thickness of the conveyed booklet T. Even a thick booklet can be positioned while the spine thereof does not get out of the positioning roller 649*a*.

The first pressing roller 650 has a first pressing surface 650*a*. The first pressing surface 650*a* presses the fold end portion of the booklet T to square the fold end portion as a deforming process. As illustrated in FIGS. 7C and 7D, the first pressing roller 650 has a diameter of D2. The first pressing roller 650 enters between the lower pressing plate 631 and the upper pressing plate 633 to deform the fold end portion of the booklet T positioned by the positioning roller 649*a*. A difference between the diameter D2 and the diameter D1 (D2−D1) of positioning roller 649*a* equals the amount of pressing (collapse) caused by the first pressing roller 650. The amount of pressing (collapse) is equivalent to a predetermined distance traveled by the first pressing roller 650 in the conveying direction toward the tip position at the fold end portion of the booklet T. The first pressing roller 650 has a width of H2 (H2<H1) and is used when the conveyed booklet T is thin (e.g., thickness of T2 to T3 to be described below).

Figure 7E:
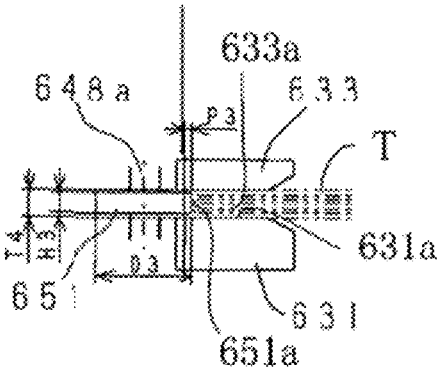
FIGS. 7E and 7F illustrate a deforming process by a second pressing roller.
Figure 7F:
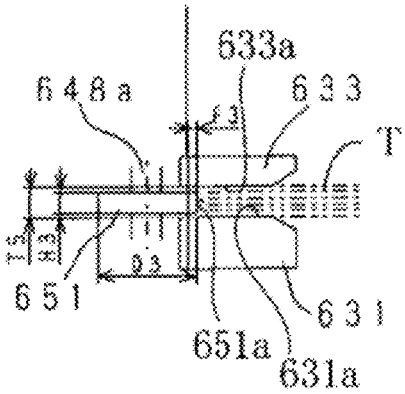

The second pressing roller 651 has a second pressing surface 651*a*. The second pressing surface 651*a* presses the fold end portion of the booklet T to square the fold end portion as a deforming process. As illustrated in FIGS. 7E and 7F, the second pressing roller 651 has a diameter of D3. The second pressing roller 651 enters between the lower pressing plate 631 and the upper pressing plate 633 and deforms the fold end portion of the booklet T positioned by the positioning roller 649*a*. A difference between the diameter D3 and the diameter D1 (D3−D1) of positioning roller 649*a* equals the amount of pressing (collapse) caused by the second pressing roller 651. The amount of pressing (collapse) is equivalent to a predetermined distance traveled by the second pressing roller 651 in the conveying direction toward the tip position at the fold end portion of the booklet T. The second pressing roller 651 has a width of H3 (H2<H3<H1) and is used when the conveyed booklet T is thick (e.g., thickness of T4 to T5 to be described below).

The positioning roller 649*a*, the first pressing roller 650, and the second pressing roller 651 are switched to each other when the switching base 644 is moved in the second direction B according to the booklet thickness. The reference position detecting sensor 659 detects a reference position for the roller selection unit 657*a* to move in the second direction B.

The second moving unit 656*b* includes a positioning unit 657*b*, a connection member 653*b*, a timing belt 652*b*, pulleys 654*b* and 655*b*, a deformation driving motor SM7, and a moving base 641*b*. The positioning unit 657*b* is connected to the timing belt 652*b* extending in the first direction A through the connection member 653*b*. The timing belt 652*b* is connected to the deformation driving motor SM7 through the pulleys 654*b* and 655*b*. The deformation driving motor SM7 drives to move the positioning unit 657*b* in the first direction A. The positioning unit 657*b* has a reference position detecting sensor 658*b*. The reference position detecting sensor 658*b* detects a reference position for movement in the first direction A.

The positioning unit 657*b* includes a support shaft 648*b* extending in the second direction B and a positioning roller 649*b*. The support shaft 648*b* is rotatably supported on the moving base 641*b*. The positioning roller 649*b* is fixed to the support shaft 648*b* and is rotatably supported on the moving base 641*b* along with the support shaft 648*b*. The positioning roller 649*b* works in conjunction with the positioning roller 649*a* and places the booklet at a position where the booklet is to be deformed.

As illustrated in FIG. 7B, the positioning roller 649*b* has a diameter of D1. The positioning roller 649*b* enters between the lower pressing plate 631 and the upper pressing plate 633 and positions the booklet T so that the fold end portion of the booklet T is positioned between the lower pressing plate 631 and the upper pressing plate 633. The positioning roller 649*b* has a positioning surface 649*c*. The positioning surface 649*c* is placed against the fold end portion of the booklet T to position the booklet T so that the booklet T does not project from the downstream end in the conveying direction. The positioning roller 649*b* has a width of H1 and is larger than the thickness of the conveyed booklet T. Even a thick booklet can be positioned while the spine thereof does not get out of the positioning roller 649*b*. According to the embodiment, the fold end portion of the booklet T does not project from the downstream end of the lower pressing plate 631 and the upper pressing plate 633 in the conveying direction. The booklet T may be positioned so that the fold end portion thereof projects from the downstream end of the lower pressing plate 631 and the upper pressing plate 633 in the conveying direction.

The outlet conveying portion 660 conveys the booklet conveyed from the deforming process executing portion 625 to the conveyor tray 670. The outlet conveying portion 660 includes a lower conveying belt portion 661, an upper conveying belt portion 662, a rotary shaft 663, and a discharge detecting sensor 664. A spring (not illustrated) applies a force to the lower conveying belt portion 661 toward the upper conveying belt portion 662. The upper conveying belt portion 662 is rotatably formed around the rotary shaft 663 toward the lower conveying belt portion 661. The lower conveying belt portion 661 and the upper conveying belt portion 662 are connected to the inlet conveying portion 620 driven by the conveying driving motor SM4. The discharge detecting sensor 664 detects a booklet discharged from the outlet conveying portion 660.

The conveyor tray 670 stacks a booklet discharged from the outlet conveying portion 660. A conveyor tray driving motor SM10 and a conveyor belt 671 are provided below the conveyor tray 670. The conveyor tray driving motor SM10 drives the conveyor belt 671 to move in the conveying direction. The conveyor belt 671 stacks booklets by repeating a predetermined amount of movement each time a booklet is discharged.

Figure 8:
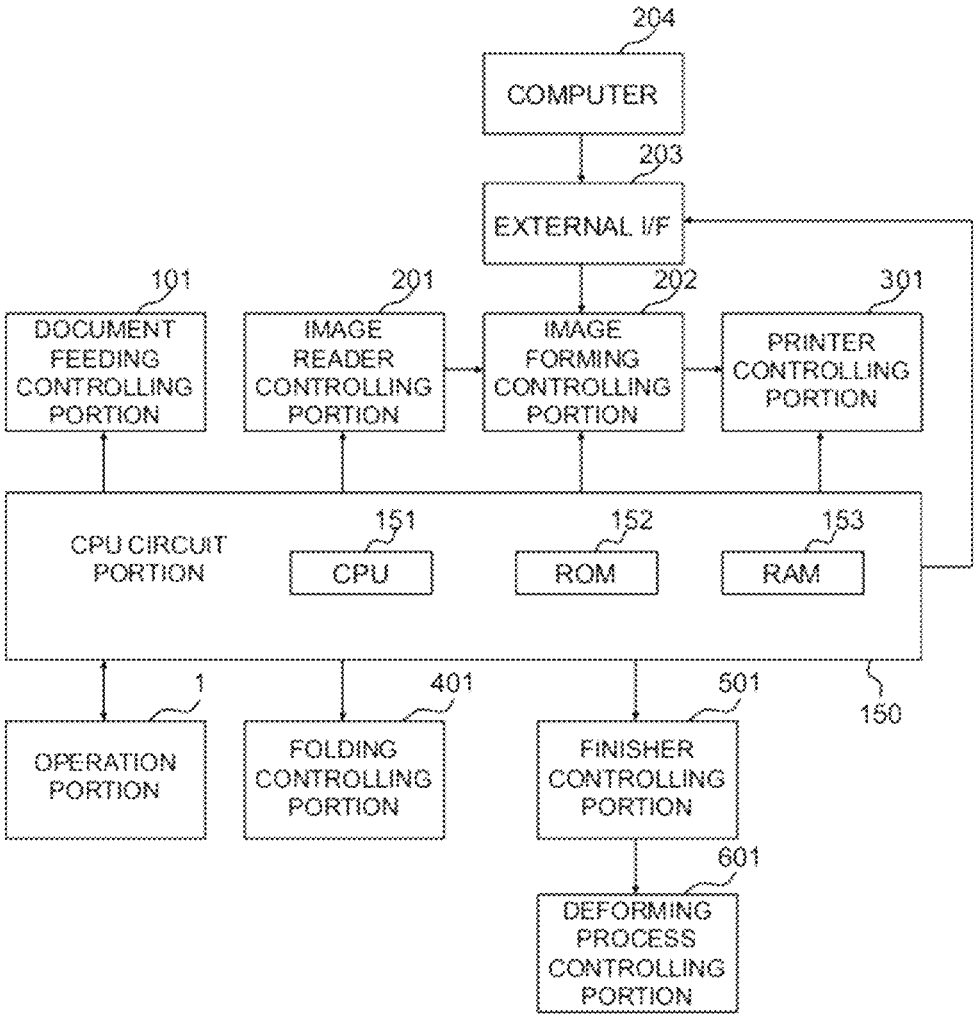
FIG. 8 is a block diagram illustrating a controlling portion of the copier according to the embodiment.
Figure 9:
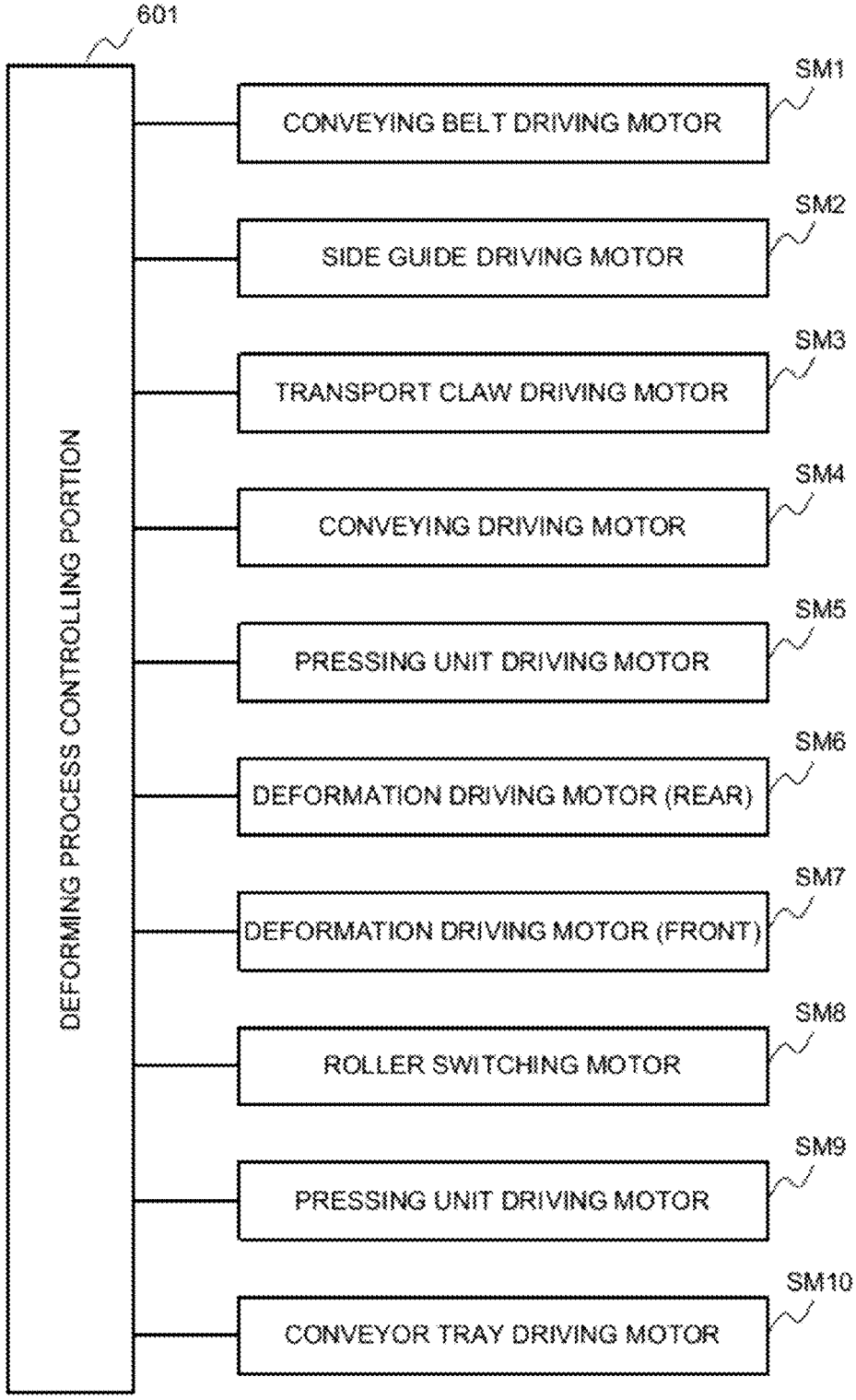
FIG. 9 is a block diagram illustrating a deforming process controlling portion according to the embodiment.

The following describes the controlling portion 1100 of the copier 1000 according to the embodiment of the invention with reference to FIGS. 8 and 9. FIG. 8 is a block diagram illustrating the controlling portion 1100 of the copier 1000 according to the embodiment. FIG. 9 is a block diagram illustrating a deforming process controlling portion 601 according to the embodiment. As illustrated in FIG. 8, the controlling portion 1100 includes a CPU circuit portion 150, a document feeding controlling portion 101, an image reader controlling portion 201, an image forming controlling portion 202, a printer controlling portion 301, and a folding controlling portion 401. The controlling portion 1100 also includes a finisher controlling portion 501 and a deforming process controlling portion 601.

The CPU circuit portion 150 includes a CPU (not illustrated), ROM 151, and RAM 152. The ROM 151 stores a control program. The RAM 152 is used as an area for temporarily storing control data or a work area for arithmetic operations associated with control operations. The CPU controls the following according to control programs stored in the ROM 151 and settings from the operation portion 1. That is, the CPU circuit portion 150 controls the document feeding controlling portion 101, the image reader controlling portion 201, the image forming controlling portion 202, the printer controlling portion 301, the folding controlling portion 401, the finisher controlling portion 501, and the deforming process controlling portion 601.

The document feeding controlling portion 101 controls the document feeding portion 100. The image reader controlling portion 201 controls the image reading portion 200. The printer controlling portion 301 controls the printer portion 300. The folding controlling portion 401 controls the folding processing portion 400. The finisher controlling portion 501 controls the finisher 500 (including the deforming process controlling portion 601) and the inserter 900. As illustrated in FIG. 9, the deforming process controlling portion 601 controls various driving motors such as the conveying belt driving motor SM1 based on various sensors such as the top dead center detecting sensor 639.

The external I/F 203 provides an interface between the copier 1000 and an external computer 204. The external I/F 203 expands print data from the computer 204 into a bitmapped image and outputs the image as image data to the image forming controlling portion 202. An image sensor (not illustrated) reads image data from a document. The image reader controlling portion 201 outputs the read image data to the image forming controlling portion 202. The image forming controlling portion 202 applies a predetermined image process to the input image data. The printer controlling portion 301 outputs the processed image data to an exposure controlling portion (not illustrated).

The operation portion 1 includes multiple keys and a display portion. The keys are used to set various functions concerning image formation. The display portion displays setting states. The operation portion 1 outputs a key signal to the CPU circuit portion 150 when a user operates each key to generate the key signal. In addition, the operation portion 1 allows a display portion (not illustrated) to display information corresponding to a signal from the CPU circuit portion 150.

Figure 10:
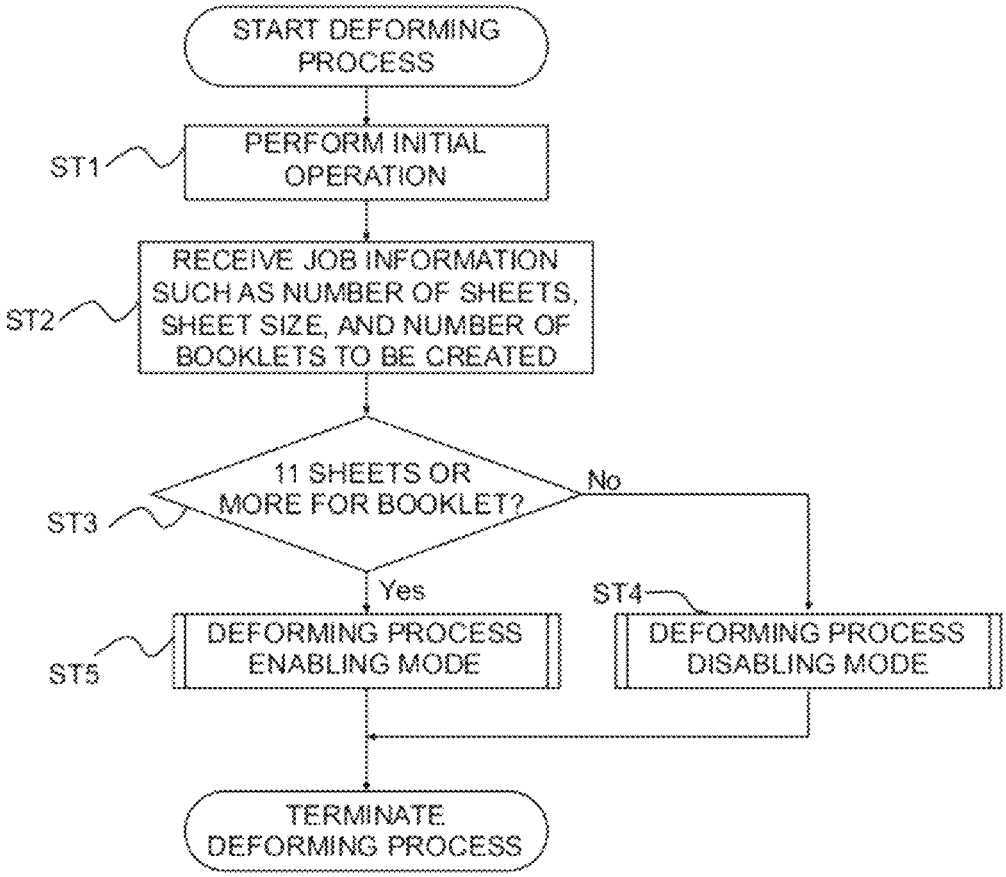
FIG. 10 is a flowchart illustrating a deforming process by the deforming process controlling portion.

The following describes a deforming process of the deforming processing portion 600 in the copier 1000 according to the embodiment with reference to FIG. 10. FIG. 10 is a flowchart illustrating a deforming process by the deforming process controlling portion.

The saddle stitch binding portion 800 according to the embodiment produces booklets each of which contains one to 25 sheets folded double. No deforming process is performed on booklets containing one to ten sheets folded double. The deforming process is performed on booklets containing 11 to 25 sheets folded double. The reason follows. A booklet containing one to ten folded sheets is thin and makes it difficult to ensure a process area (pressing amount) for deforming the fold end portion. In addition, such a thin booklet, if deformed, hardly illustrates a visible change in the fold end portion of the booklet.

Booklets containing 11 to 25 folded sheets are deformed and are grouped into three thickness stages because of a range of booklet thicknesses. The first pressing roller 650 having the width of H2 is selected for booklet thicknesses T2 to T3 (T2<T3). A gap between the lower pressing plate 631 and the upper pressing plate 633 is set to T2 (see FIGS. 7C and 7D). The third pressing roller 651 having the width of H3 is selected for booklet thicknesses T4 to T5 (T4<T5). A gap between the lower pressing plate 631 and the upper pressing plate 633 is set to T3 (see FIGS. 7D and 7F). A more specific description follows.

The deforming process can be selected when a saddle stitching process mode is selected on the operation portion 1. When the deforming process is not selected, a booklet produced in the saddle stitch binding portion 800 is discharged to the conveyor tray 670 through the lower conveying belt 611, the transport claw 613, the inlet conveying portion 620, and the outlet conveying portion 660. The pair of side guides 612, the upper pressing plate 683, and the moving units 656*a* and 656*b* are retracted so as not to hinder the conveying path.

The deforming processing portion 600 performs an initial operation (step ST1) as illustrated in FIG. 10 when the saddle stitching process mode is selected and the deforming process starts. Specifically, the pair of side guides 612 and the transport claw 613 are moved to the reference positions. The pressing base 632 is moved to the upper position (top dead center detecting sensor 639 turned on). The first moving unit 656*a* and the second moving unit 656*b* are moved to the reference positions (reference position detecting sensors 658*a* and 658*b* turned on). Similarly, the roller selection unit 657*a* is moved to the reference position (reference position detecting sensor 659 turned on).

After the initial operation, the deforming process controlling portion 601 is notified of the number of sheets per booklet, the sheet size, and the number of booklets to be produced (step ST2). The deforming process controlling portion 601 receives the number of sheets and the other information and determines whether the number of sheets per booklet is ten or smaller (step ST3). The deforming process disabling mode is selected to omit the deforming process when the number of sheets per booklet is ten or smaller. A process in the deforming process disabling mode is performed (step ST4). The deforming process enabling mode is selected when the number of sheets per booklet is 11 or more. A process in the deforming process enabling mode is performed (step ST5). The saddle stitching process terminates when the deforming process disabling mode or the deforming process enabling mode terminates.

Figure 11:
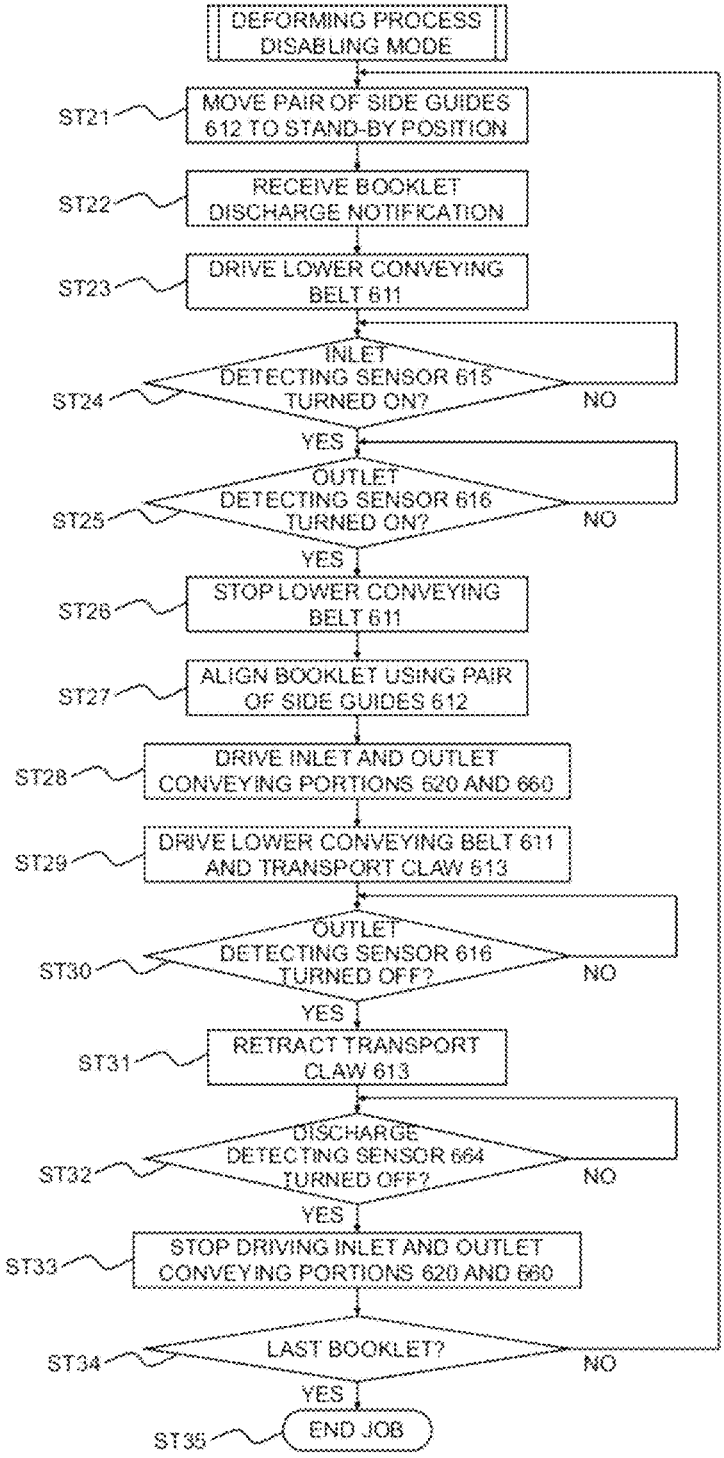
FIG. 11 is a flowchart illustrating a deforming process disabling mode in a saddle stitching process.

With reference to FIG. 11, the following describes the deforming process disabling mode selected when the number of sheets per booklet is ten or smaller. FIG. 11 is a flowchart illustrating the deforming process disabling mode in the saddle stitching process. As illustrated in FIG. 11, selecting the deforming process disabling mode moves the pair of side guides 612 to a stand-by position (both sides of the lower conveying belt 611) according to the booklet size (step ST21). The pair of side guides 612 is provided on both sides of the conveying path for the booklet receiving portion 610. The pair of side guides 612 moves then a booklet discharge notification is received from the saddle stitch binding portion 800 (step ST22). The conveying belt driving motor SM1 rotates the lower conveying belt 611 to convey the booklet (step ST23).

The lower conveying belt 611 conveys the booklet and the inlet detecting sensor 615 detects the booklet on the lower conveying belt 611 (step ST24). Control then proceeds to step ST25. Step ST24 is repeated until the inlet detecting sensor 615 detects the booklet. The conveying belt driving motor SM1 stops (step ST26) when the outlet detecting sensor 616 detects the booklet at step ST25. Step ST25 is repeated until the outlet detecting sensor 616 detects the booklet. The side guide driving motor SM2 drives when the conveying belt driving motor SM1 stops. The pair of side guides 612 aligns the booklet (step ST27).

When the booklet alignment terminates, the conveying driving motor SM4 drives the inlet conveying portion 620 and the outlet conveying portion 660 (step ST28). The transport claw 613 and the lower conveying belt 611 provided upstream of the booklet receiving portion 610 are driven to restart the booklet conveyance (step ST29). The outlet detecting sensor 616 detects that the booklet is discharged (step ST30). The transport claw 613 then retracts upstream in the conveying direction (step ST31) to stop driving.

The inlet conveying portion 620 and the outlet conveying portion 660 convey the booklet that is then discharged to the conveyor tray 670. The discharge detecting sensor 664 detects the booklet (step ST32) when the booklet is discharged to the conveyor tray 670. The inlet conveying portion 620 and the outlet conveying portion 660 then stop driving (step ST33). The booklets discharged to the conveyor tray 670 are successively stacked imbricately. Control returns to step ST21 when the discharged booklet is not the last one. The deforming process disabling mode terminates (step ST35) when the last booklet is discharged (step ST34).

Figure 12:
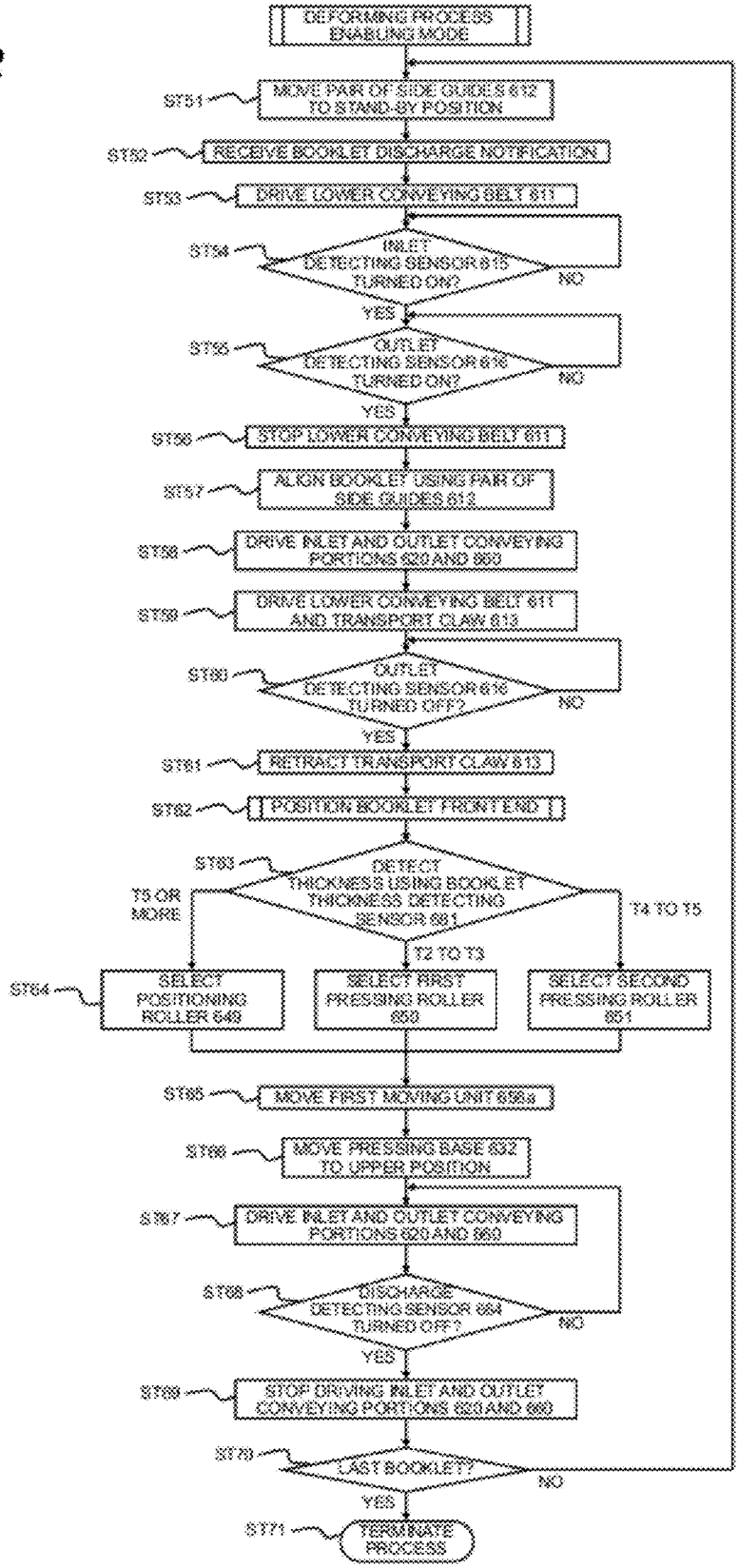
FIG. 12 is a flowchart illustrating a deforming process enabling mode in a saddle stitching process.

With reference to FIGS. 12 through 16, the following describes the deforming process enabling mode selected when the number of sheets per booklet is 11 or more. FIG. 12 is a flowchart illustrating a deforming process enabling mode in the saddle stitching process. FIG. 13A illustrates positioning of a booklet by placing the positioning rollers 649*a* and 649*b* against the booklet fold end portion. FIG. 13B illustrates a deforming process by the second pressing roller 651. FIG. 14A illustrates positioning of a booklet by placing the positioning rollers 649*a* and 649*b* against the booklet fold end portion. FIG. 14B illustrates the positioning rollers 649*a* and 649*b* retracted after positioning. FIG. 15A illustrates the roller selection unit 657*a* slid to the second direction B to select the second pressing roller 651. FIG. 15B illustrates a deforming process using the second pressing roller 651. FIG. 16A illustrates the second pressing roller 651 retracted after the deforming process. FIG. 16B illustrates a booklet conveyed after the deforming process is completed.

As illustrated in FIG. 12, selecting the deforming process enabling mode moves the pair of side guides 612 to the stand-by position according to the booklet size (step ST51). The roller selection unit 657*a* selects the positioning roller 649*a*. The first and second moving units 656*a* and 656*b* move to a booklet positioning position. The booklet positioning position depends on booklet sizes in the width direction orthogonal to the conveying direction. For example, the booklet positioning position is settled so that placing the booklet fold end portion against the positioning rollers 649*a* and 649*b* does not rotate the booklet and the booklet fold end portion is kept parallel to the first direction A (e.g., see FIG. 14A).

The booklet discharge notification is received from the saddle stitch binding portion 800 (step ST52). The conveying belt driving motor SM1 drives the lower conveying belt 611 (step ST53) to convey the booklet. The inlet detecting sensor 615 detects the booklet on the lower conveying belt 611 (step ST54) when the lower conveying belt 611 conveys the booklet. Control then proceeds to step ST55. Step ST54 is repeated until the inlet detecting sensor 615 detects the booklet. The conveying belt driving motor SM1 stops (step ST56) when the outlet detecting sensor 616 detects the booklet at step ST55. Step ST56 is repeated until the outlet detecting sensor 616 detects the booklet. The side guide driving motor SM2 drives when the conveying belt driving motor SM1 stops. The pair of side guides 612 performs an alignment operation (step ST57).

The conveying driving motor SM4 drives the inlet conveying portion 620 (step ST58) when the alignment operation terminates. The transport claw 613 and the lower conveying belt 611 provided upstream of the booklet receiving portion 610 in the conveying direction are driven to restart the booklet conveyance (step ST59). The outlet detecting sensor 616 detects that the booklet is discharged (step ST60). The transport claw 613 then retracts upstream in the conveying direction (step ST61). The transport claw 613 stops driving.

A tip positioning process and a tip positioning process (step ST62) are performed on the booklet T after the transport claw 613 stops.

Figure 13A:
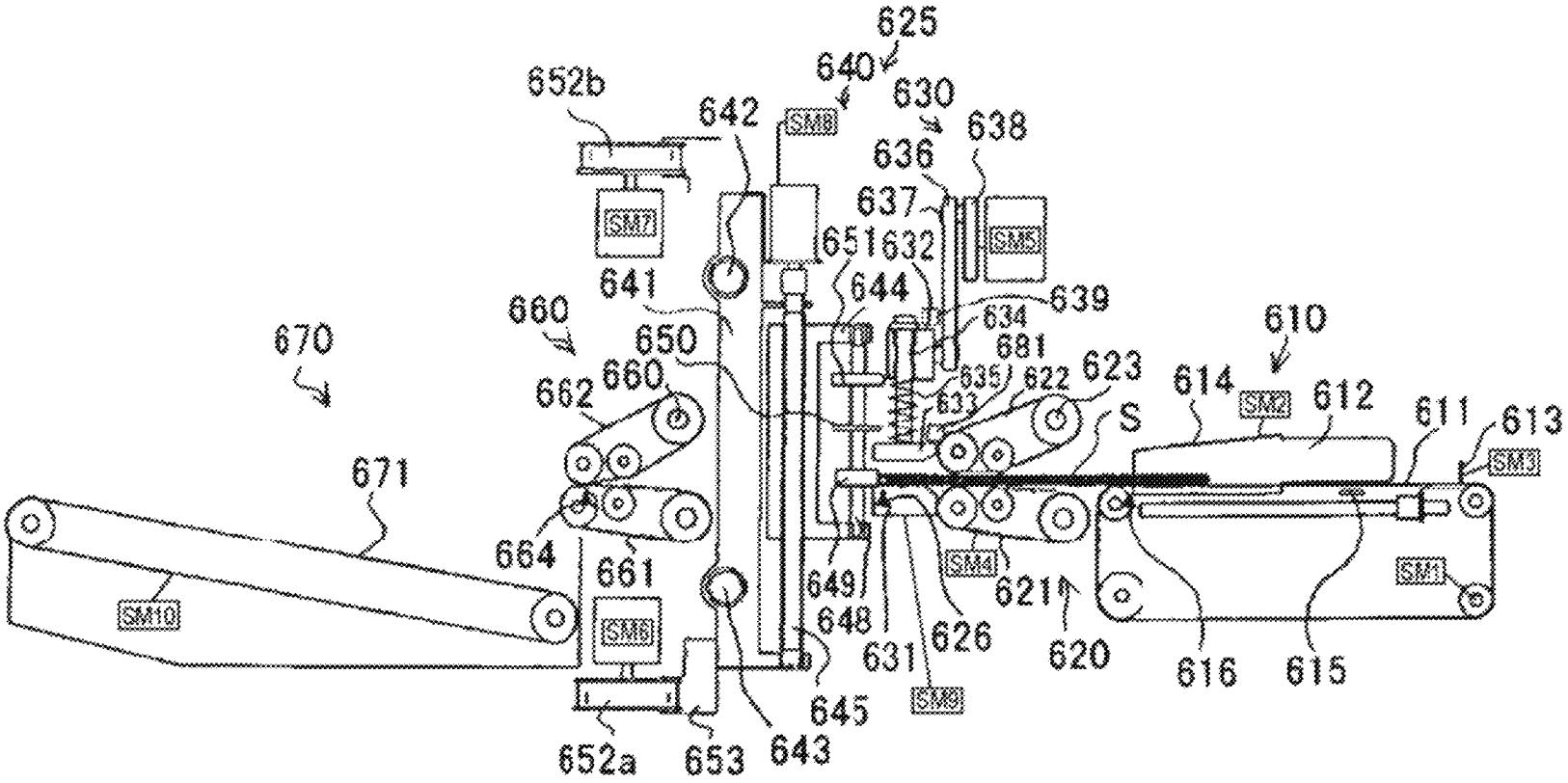
FIG. 13A illustrates positioning of a booklet by placing the positioning roller against a fold end portion of the booklet.
Figure 13B:
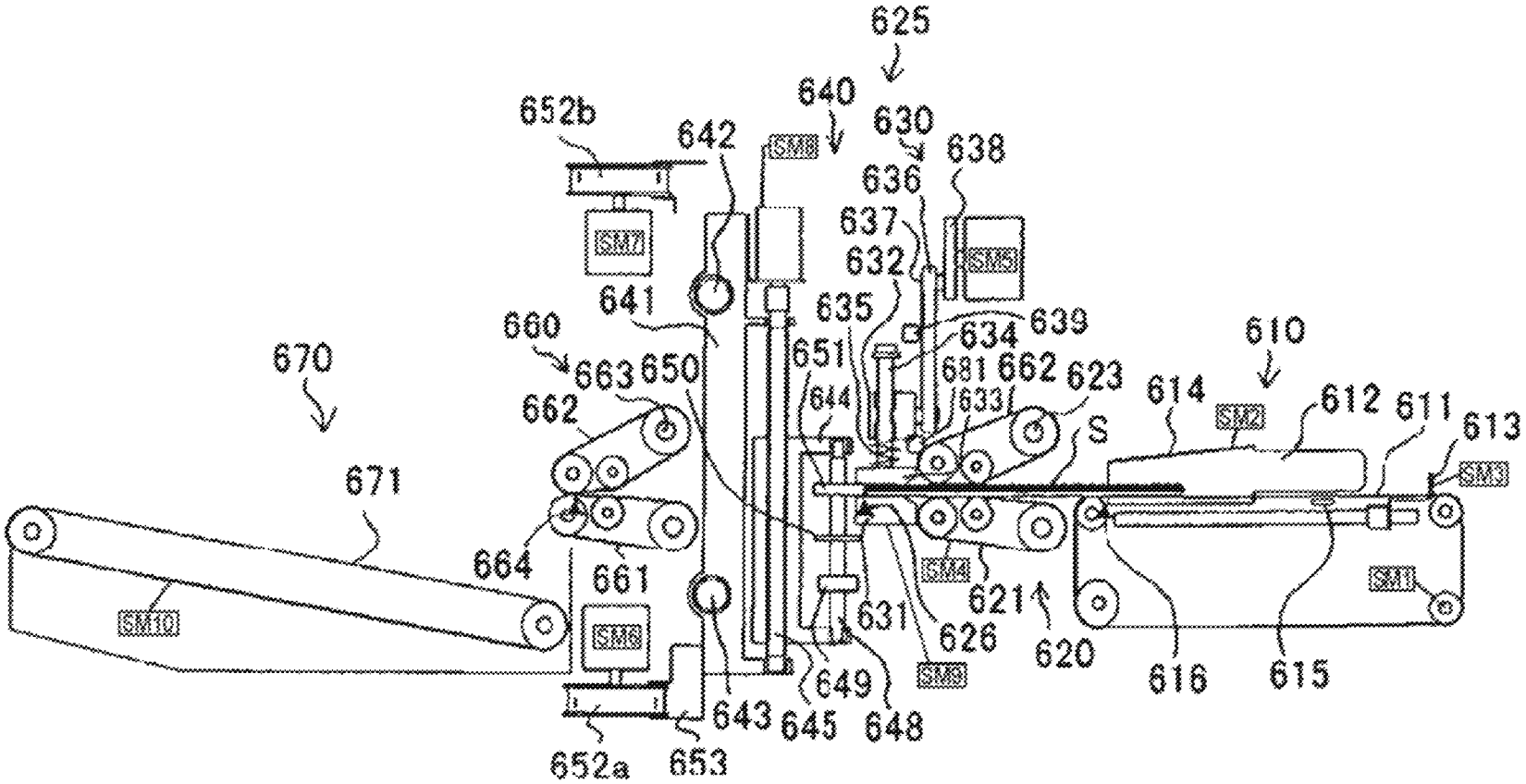
FIG. 13B illustrates a deforming process by the second pressing roller.

As illustrated in FIG. 13A, the positioning rollers 649*a* and 649*b* perform the tip positioning process on the booklet T. The positioning rollers 649*a* and 649*b*, the first pressing roller 650, and the second pressing roller 651 become movable when the first and second moving units 656*a* and 656*b* move in the first direction A between the upper pressing plate 633 and the lower pressing plate 631 of the pressing unit 630. The roller selection unit 657*a* moves in the second direction B when the first moving unit 656*a* is not positioned between the upper pressing plate 633 and the lower pressing plate 631 (positioned outside both sides of the upper pressing plate 633 and the lower pressing plate 631). The rollers positioned between the upper pressing plate 633 and the lower pressing plate 631 are switched to each other in this manner.

Figure 14A:
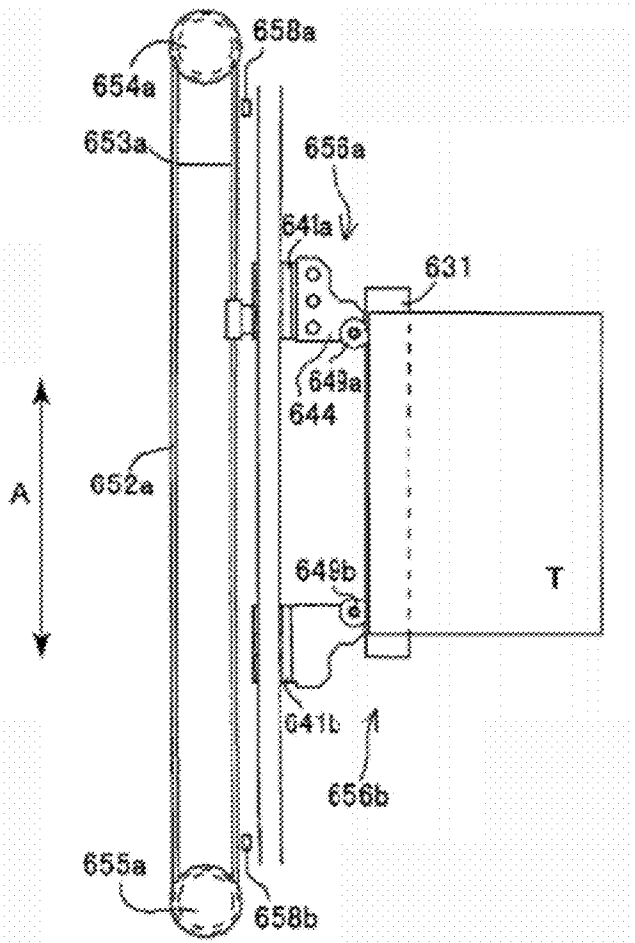
FIG. 14A illustrates positioning of a booklet by placing the positioning roller against a fold end portion of the booklet.

As illustrated in FIG. 14A, for example, the pressing unit 630 positions the booklet T while the positioning rollers 649*a* and 649*b* are symmetrically positioned between the upper pressing plate 633 and the lower pressing plate 631 within the booklet width. The fold end portion of the booklet T can be positioned in contact with the rollers. The booklet T moves and stops at a predetermined position detected by the tip detecting sensor 626. The fold end portion of the booklet T contacts the positioning rollers 649*a* and 649*b* at the predetermined position.

Figure 14B:
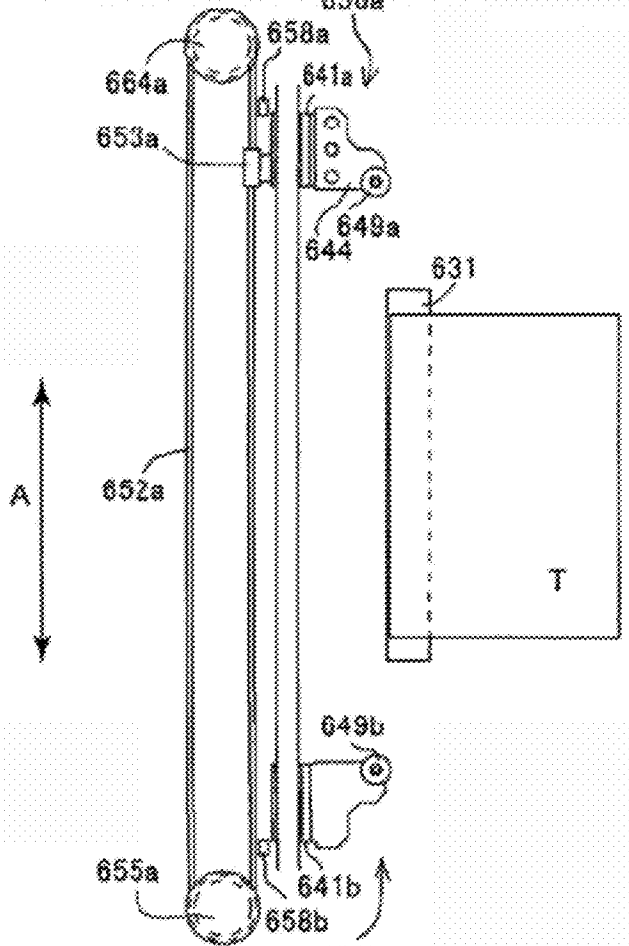
FIG. 14B illustrates the positioning roller retracted after positioning.

When the positioning is completed as illustrated in FIG. 14B, the first and second moving units 656*a* and 656*b* move to a stand-by position outside the range between the upper pressing plate 633 and the lower pressing plate 631. Namely, the stand-by position is found outside both ends of the upper pressing plate 633 and the lower pressing plate 631. The positioning rollers 649*a* and 649*b* are higher than the booklet thickness so that even a thick booklet can be positioned with the fold end portion of the booklet placed against the positioning rollers. Accordingly, the upper pressing plate 633 cannot fix a booklet when the positioning rollers 649*a* and 649*b* are positioned between the upper pressing plate 633 and the lower pressing plate 631. As illustrated in FIG. 14B, the positioning rollers 649*a* and 649*b* move outside both ends of the upper pressing plate 633 and the lower pressing plate 631 after the booklet positioning. The upper pressing plate 633 and the lower pressing plate 631 then fix (hold) the booklet so that the fold end portion thereof is nipped. The booklet is nipped between the lower conveying belt portion 621 and the upper conveying belt portion 622 of the inlet conveying portion 620 and stays unmovable.

The tip positioning process is performed (step ST62) when the first and second moving units 656*a* and 656*b* move to the stand-by position. To perform the tip positioning process, the pressing unit driving portion 627 moves the pressing unit 630 to a predetermined position based on the tip position of the booklet.

The booklet thickness is detected when the pressing unit driving portion 627 terminates the tip positioning process. At this time, the booklet is held so that the fold end portion thereof is positioned between the first holding surface 631*a* of the lower pressing plate 631 and the second holding surface 633*a* of the upper pressing plate 633. Specifically, the booklet thickness detecting sensor 681 detects the position of the upper pressing plate 633 that fixes the booklet. This measures the booklet thickness (step ST63). The roller selection driving motor SM8 moves the switching base 644 to the second direction B when the booklet thickness ranges from T2 to T3 (mm). The first pressing roller 650 moves to a predetermined position. The pressing unit driving motor SM5 drives to move the upper pressing plate 633 to the second direction B. A gap between the upper pressing plate 633 and the lower pressing plate 631 is adjusted to T2 (see FIG. 7C).

The roller selection driving motor SM8 moves the switching base 644 to the second direction B when the booklet thickness ranges from T4 to T5 (mm). The second pressing roller 651 moves to a predetermined position (see FIG. 13B). The pressing unit driving motor SM5 drives to move the upper pressing plate 633 to the second direction B. A gap between the upper pressing plate 633 and the lower pressing plate 631 is adjusted to T4 (see FIG. 7E).

The roller selection driving motor SM8 moves the switching base 644 to the second direction B when the booklet thickness is T5 (mm) or more. The positioning roller 649 moves to a predetermined position. The pressing unit driving motor SM5 drives to move the upper pressing plate 633 to the second direction B. A gap between the upper pressing plate 633 and the lower pressing plate 631 is adjusted to a predetermined value.

Figure 15A:
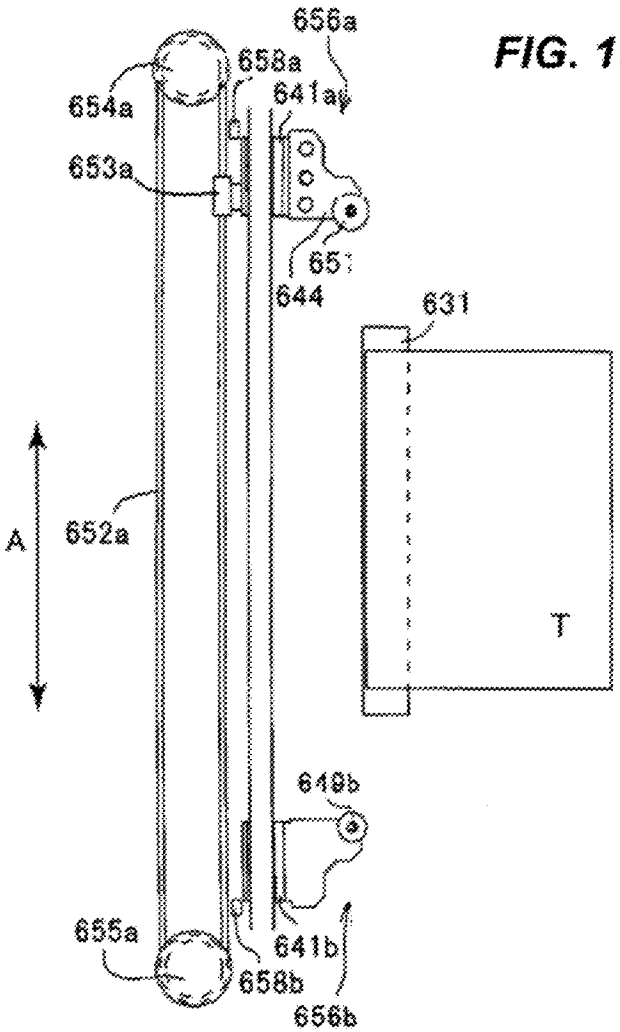
FIG. 15A illustrates a roller selection unit slid to the second direction to select the second pressing roller.
Figure 15B:
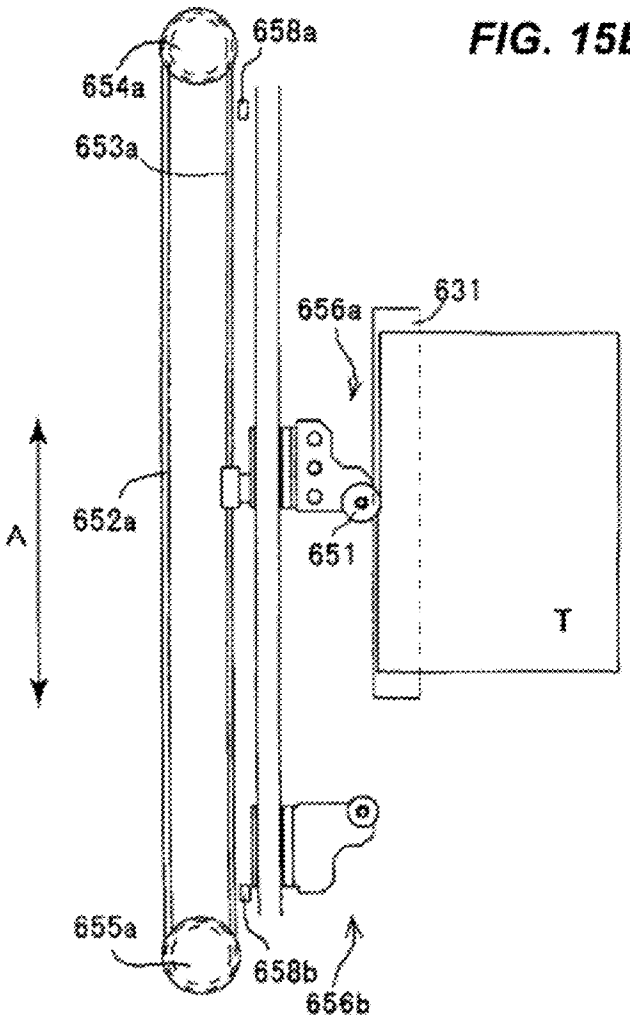
FIG. 15B illustrates a deforming process using the second pressing roller.

For example, the second pressing roller 651 is selected as illustrated in FIG. 15A. The gap between the upper pressing plate 633 and the lower pressing plate 631 is adjusted to T4. The first moving unit 656*a* is then moved as illustrated in FIG. 15B. The booklet fold end portion is deformed as described above (step ST65).

Figure 16A:
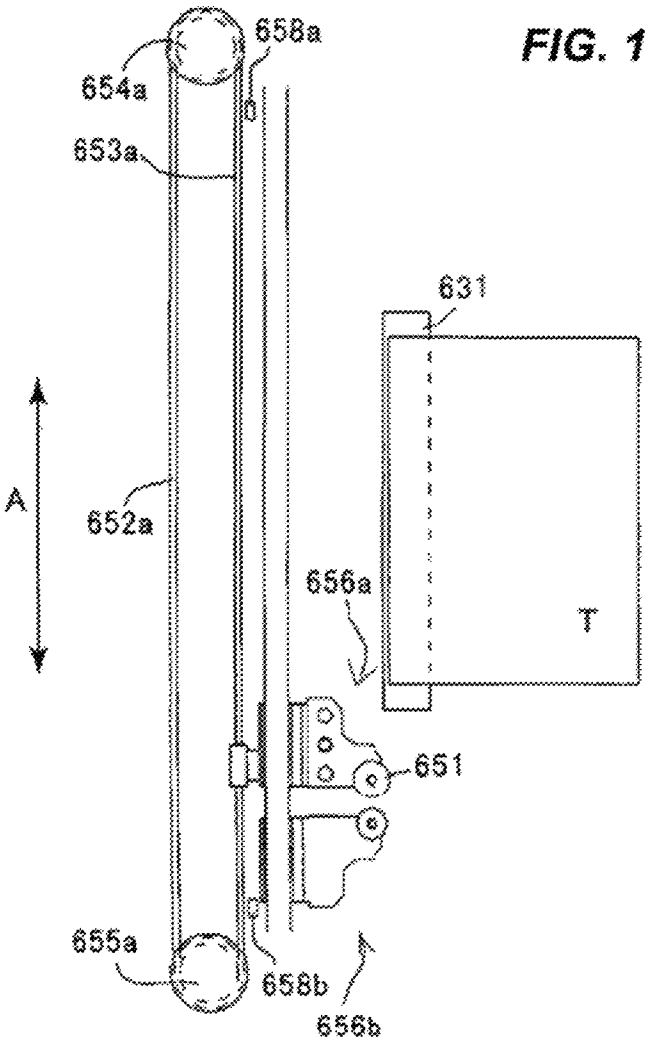
FIG. 16A illustrates the second pressing roller retracted after the deforming process.
Figure 16B:
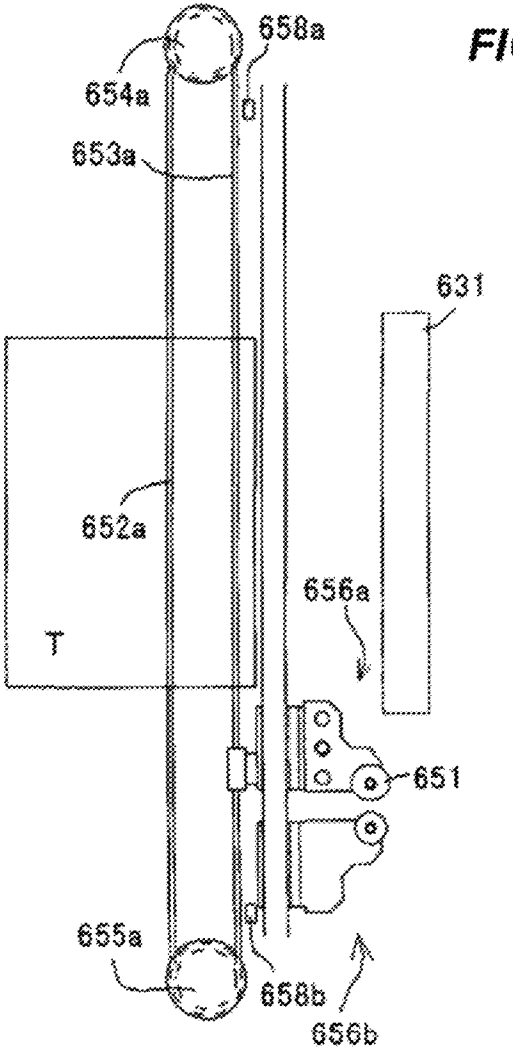
FIG. 16B illustrates a booklet conveyed after the deforming process is completed.

As illustrated in FIG. 16A, the pressing base 632 moves to the upper position (step ST66) when the first moving unit 656*a* stops moving and the second pressing roller 651 retracts. The upper pressing plate 633 and the lower pressing plate 631 separate from each other. As illustrated in FIG. 16B, the conveying driving motor SM4 drives the outlet conveying portion 660 (step ST67). The booklet conveyed by the outlet conveying portion 660 is discharged to the conveyor tray 670.

The discharge detecting sensor 664 detects the booklet (step ST68) after the booklet is discharged to the conveyor tray 670. The conveying driving motor SM4 then stops to stop the outlet conveying portion 660 (step ST69). The booklets discharged to the conveyor tray 670 are successively stacked imbricately. Control returns to step ST51 when the discharged booklet is not the last one. The deforming process enabling mode terminates (step ST71) when the last booklet is discharged (step ST70).

Figure 17:
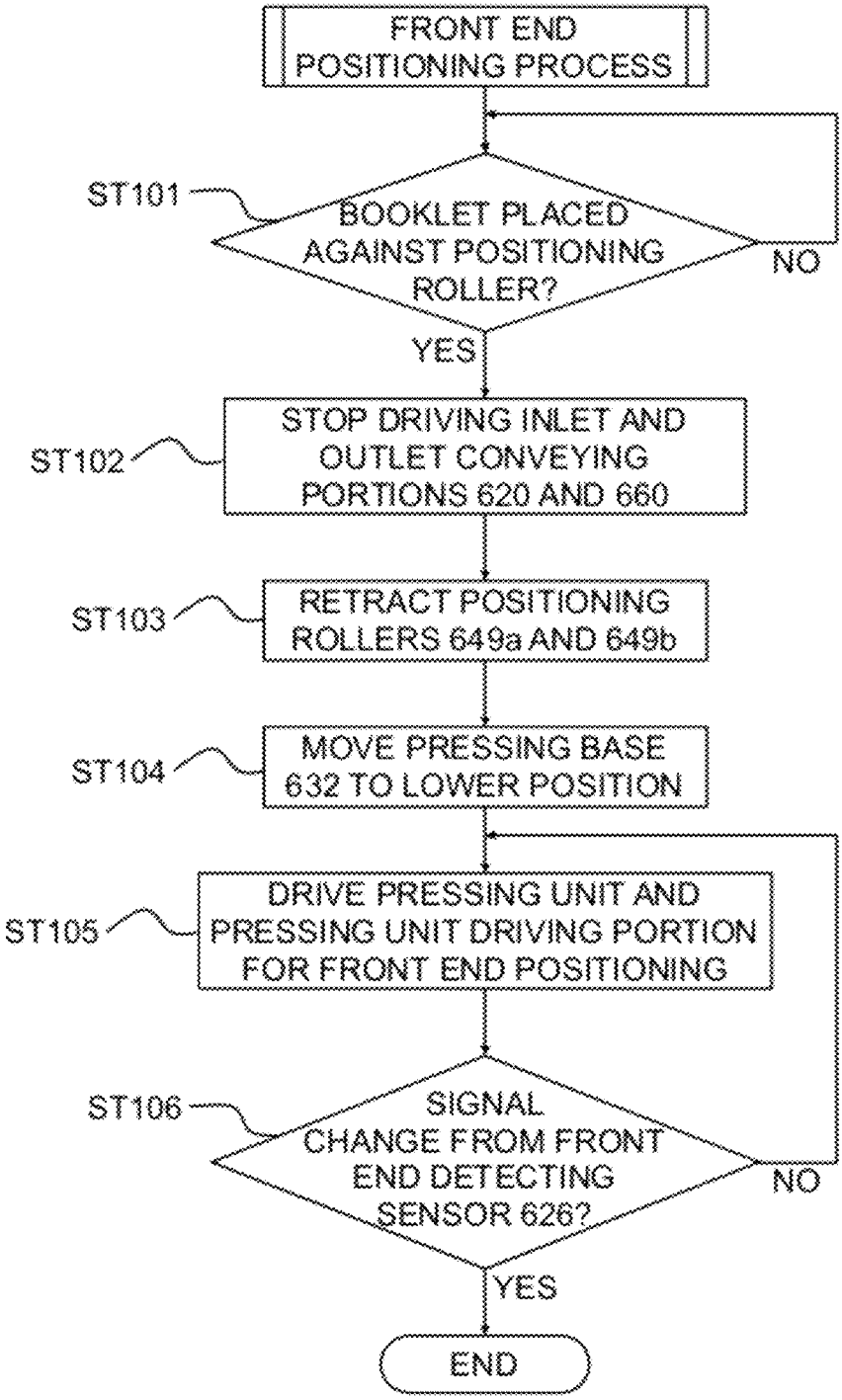
FIG. 17 is a flowchart illustrating a tip positioning process in a deforming process enabling mode.

The following describes the tip positioning process with reference to FIG. 17. FIG. 17 is a flowchart illustrating the tip positioning process in the deforming process enabling mode. As illustrated in FIG. 17, the tip positioning process starts and places the booklet against the positioning rollers 649*a* and 649*b* to complete the positioning (step ST101). The inlet conveying portion 620 then stops driving (step ST102). At this time, the tip positioning process using the positioning rollers 649*a* and 649*b* has positioned the booklet so that the fold end portion thereof is located between the upper pressing plate 633 and the lower pressing plate 631 as illustrated in FIG. 13A. Control skips step ST102 and proceeds to the next step when the tip positioning process using the positioning rollers 649*a* and 649*b* already stops driving the inlet conveying portion 620. As illustrated in FIG. 14B, the positioning rollers 649*a* and 649*b* retract from the booklet positioning position (step ST103).

The pressing unit driving motor SM5 lowers the pressing base 632. The booklet is held so as to be nipped between the upper pressing plate 633 and the lower pressing plate 631 (step ST104). The booklet is pressed in the thickness direction when the booklet is nipped between the upper pressing plate 633 and the lower pressing plate 631. The fold end portion is accordingly deformed so as to project in the conveying direction (direction of the pressing roller to be inserted). The fold end portion tends to be deformed more remarkably as the number of sheets contained in the booklet increases. There are layers of air between sheets contained in the booklet before nipped between the upper pressing plate 633 and the lower pressing plate 631. The sheets are compressed in the width direction when the booklet is pressed in the width direction. The compression decreases not only the booklet thickness but also the curvature radius of a curved portion in the fold end portion. The fold end portion is deformed so as to project due to a difference in circumferential lengths of the curved portion before and after the deformation. The fold end portion deformation depends on not only the number of sheets but also the sheet rigidity resulting from the sheet basis weight or thickness, for example. When the booklet fold end portion projects in the conveying direction, the pressing unit moving motor SM9 drives until the tip detecting sensor 626 detects a change in a detection signal corresponding to the tip position of the fold end portion (steps ST105 and ST106).

For example, the pressing unit moving motor SM9 moves the pressing unit 630 upstream in the booklet conveying direction away from the pressing roller until the tip detecting sensor 626 turns off when the tip detecting sensor 626 turns on to detect the tip of the fold end portion. The tip detecting sensor 626 detects a predetermined positioning position to position the booklet. The booklet nipped between the upper pressing plate 633 and the lower pressing plate 631 causes a large amount of projection (deformation amount) when the tip detecting sensor 626 detects the booklet fold end portion. The booklet is moved together with the pressing unit 630 in the direction away from the pressing roller in order to avoid too large an amount of pressing (collapse).

On the other hand, the pressing unit moving motor SM9 moves the tip detecting sensor 626 until the tip detecting sensor 626 turns on, downstream in the booklet conveying direction so as to approach the pressing roller when the tip detecting sensor 626 does not detect the tip of the fold end portion. The tip detecting sensor 626 detects a predetermined positioning position to position the booklet. The booklet nipped between the upper pressing plate 633 and the lower pressing plate 631 causes a small amount of projection (deformation amount) when the tip detecting sensor 626 does not detect the booklet fold end portion. The booklet is moved together with the pressing unit 630 in the direction nearer to the pressing roller in order to avoid too small an amount of pressing (collapse).

The booklet is moved together with the pressing unit 630 so that the pressing roller presses the booklet fold end portion at the predetermined position based on the tip position of the booklet that is nipped to hold the booklet and projected. In other words, the pressing unit driving portion 627 is controlled according to the amount of booklet deformation to move the pressing unit 630. The tip positioning process for the booklet terminates (step ST107) when the pressing unit moving motor SM9 has completely moved the pressing unit 630.

The copier 1000 having the above-described configuration according to the embodiment provides the following effects. In the copier 1000 according to the embodiment, the upper pressing plate 633 and the lower pressing plate 631 nip the booklet to hold the booklet. The pressing unit driving portion 627 then moves the pressing unit 630 to move the tip position of the fold end portion according to the amount of booklet deformation (the tip position of the fold end portion). The copier can ensure a predetermined distance between the pressing roller (positioning roller 649*a*, first pressing roller 650, or second pressing roller 651 according to the embodiment) and the tip position of the booklet fold end portion. The pressing roller can ensure a constant amount of pressing (collapse) at the fold end portion even when the tip position of the fold end portion varies with different amounts of fold end portion deformation. The pressing roller can always press booklets at a predetermined pressure. Fold end portions can be uniformly shaped. The quality of finished booklets can be ensured. As a result, the copier can prevent the fold end portion from bending and stably form the fold.

Figure 18:
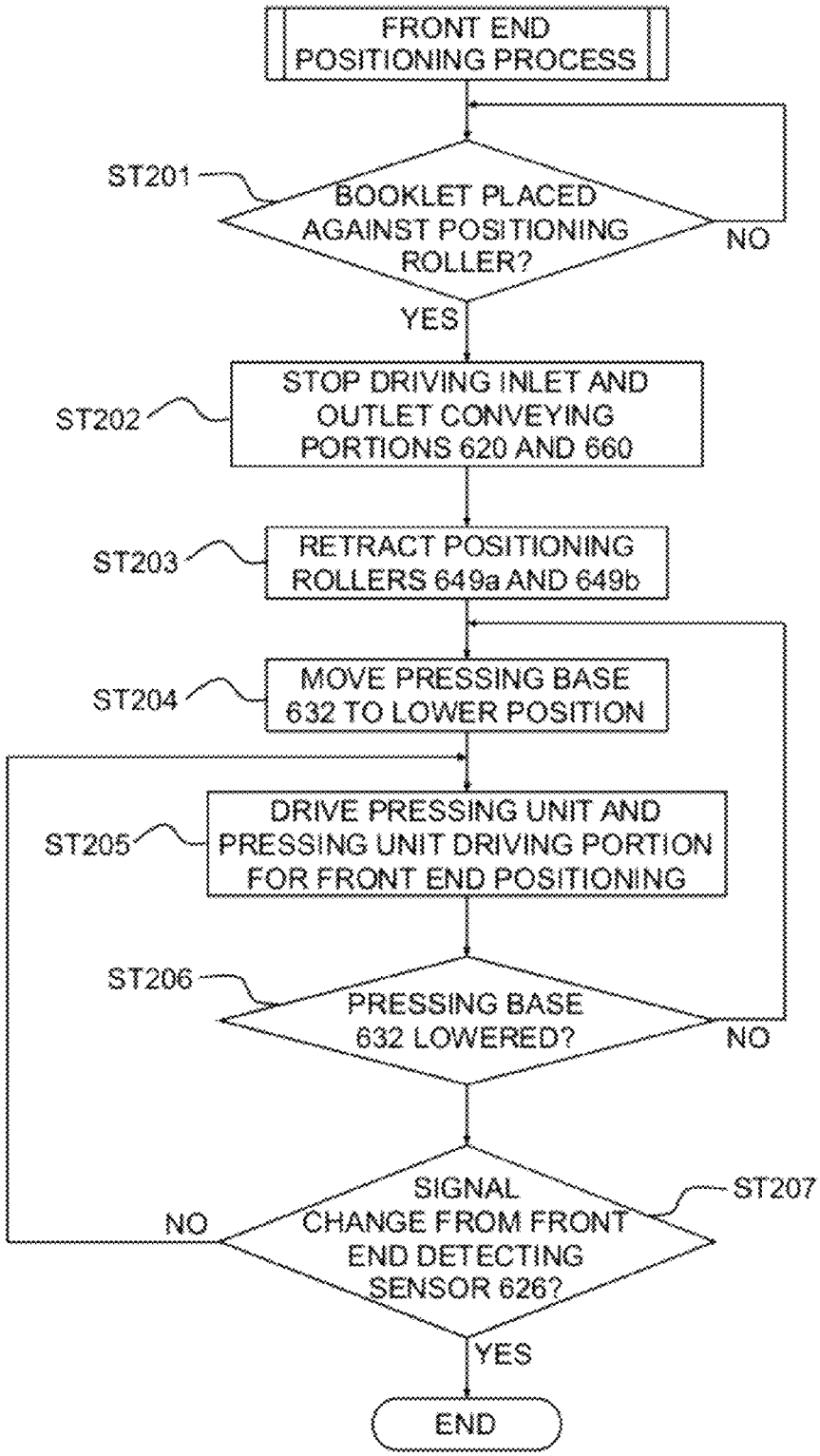
FIG. 18 illustrates the tip positioning process in a deforming process enabling mode while the booklet is held.
Figure 19:
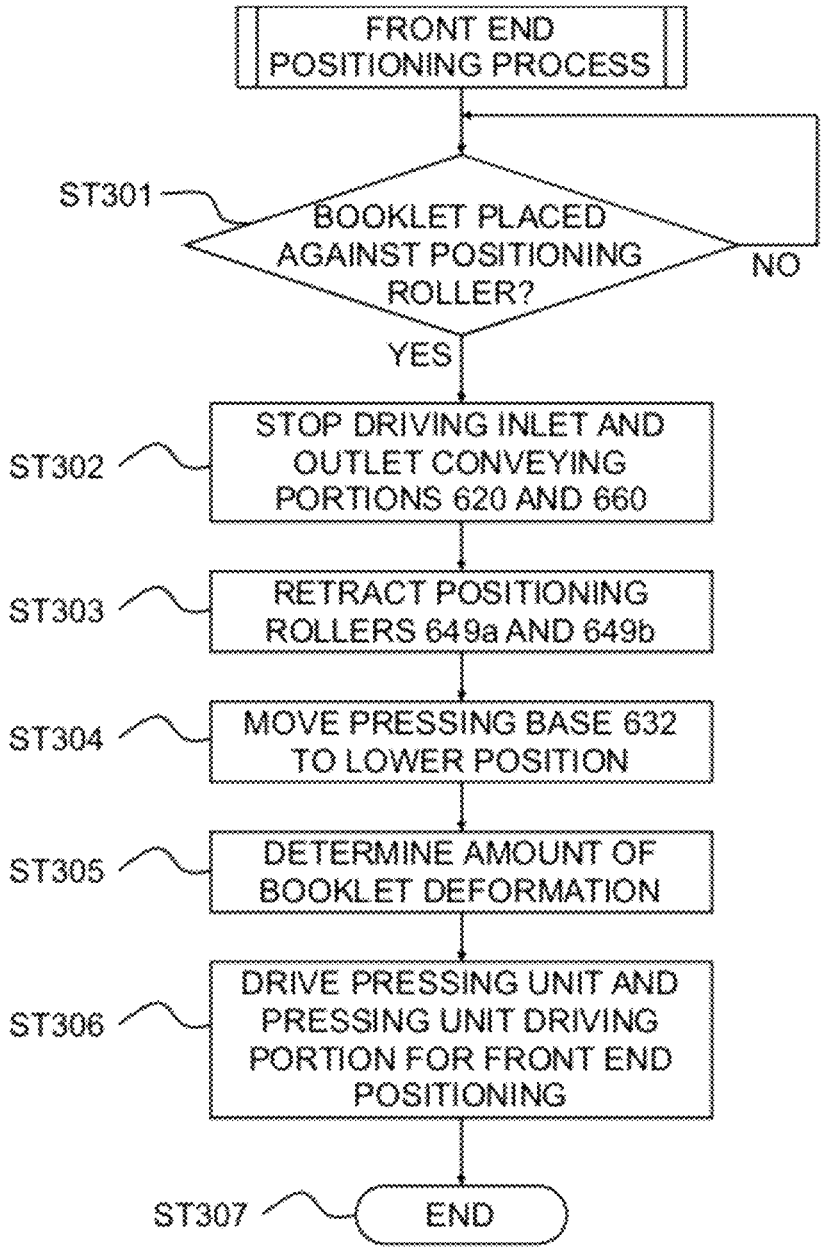
FIG. 19 illustrates the tip positioning process in a deforming process enabling mode in order to determine the amount of projection based on a booklet thickness.

With reference to FIGS. 18 and 19, the following describes the other embodiments (modifications) of the tip positioning process in the deforming process enabling mode. FIG. 18 illustrates the tip positioning process in the deforming process enabling mode while the booklet is held. FIG. 19 illustrates the tip positioning process in the deforming process enabling mode in order to determine the amount of projection based on a booklet thickness.

First Modification

The tip positioning process in the deforming process enabling mode according to the first modification differs from the embodiment in that the pressing unit moving motor SM9 drives while the upper pressing plate 633 and the lower pressing plate 631 hold a booklet. The first modification describes only differences from the embodiment and will not be repeated. A description about the same contents as the embodiment. The same effect as the embodiment is ensured for a configuration that is common to the first modification and the embodiment.

As illustrated in FIG. 18, the tip positioning process starts and places the booklet against the positioning rollers 649*a* and 649*b* to complete the positioning (step ST201). The inlet conveying portion 620 then stops driving (step ST202). At this time, the tip positioning process using the positioning rollers 649*a* and 649*b* has positioned the booklet so that the fold end portion thereof is located between the upper pressing plate 633 and the lower pressing plate 631 as illustrated in FIG. 13A. Control skips step ST202 and proceeds to the next step when the tip positioning process using the positioning rollers 649*a* and 649*b* already stops driving the inlet conveying portion 620. As illustrated in FIG. 14B, the positioning rollers 649*a* and 649*b* retract from the booklet positioning position (step ST203).

The pressing unit driving motor SM5 lowers the pressing base 632. The booklet is held so as to be nipped between the upper pressing plate 633 and the lower pressing plate 631 (step ST204). The booklet is pressed in the thickness direction when the booklet is nipped between the upper pressing plate 633 and the lower pressing plate 631. The fold end portion is accordingly deformed so as to project in the conveying direction (direction of the pressing roller to be inserted). When the booklet fold end portion projects in the conveying direction, the pressing unit moving motor SM9 drives until the tip detecting sensor 626 detects a change in a detection signal corresponding to the tip position (steps ST205 and ST207).

For example, the pressing unit moving motor SM9 moves the pressing unit 630 upstream in the booklet conveying direction away from the pressing roller when the tip detecting sensor 626 detects the tip of the fold end portion. On the other hand, the pressing unit moving motor SM9 moves downstream in the booklet conveying direction so as to approach the pressing roller when the tip detecting sensor 626 does not detect the booklet (the tip of the fold end portion). The pressing unit moving motor SM9 drives while the pressing unit moving motor SM5 drives.

While the booklet is held, the booklet is moved together with the pressing unit 630 so that the pressing roller presses the booklet fold end portion at the predetermined position based on the tip position of the booklet that is held and projected. The tip positioning process for the booklet terminates (step ST207) when the pressing unit moving motor SM9 has completely moved the pressing unit 630 (positioning operation) and the pressing unit moving motor SM5 has completely moved the pressing base 632 (booklet holding operation) (step ST206).

The tip positioning process according to the other embodiment illustrated in FIG. 18 provides the following effects in addition to the effects of the above-described embodiment. In the copier 1000 according to the first modification, the upper pressing plate 633 and the lower pressing plate 631 nip the booklet to hold it. The pressing unit driving portion 627 then moves the pressing unit 630 to control the tip position of the booklet fold end portion according to the amount of booklet deformation (the tip position of the fold end portion). The booklet can be positioned and held simultaneously. The booklet can be positioned and held simultaneously in a shorter time than the time required for the above-described embodiment.

Second Modification

The tip positioning process in the deforming process enabling mode according to a second modification differs from the embodiment in that the booklet thickness determines the amount of projection (tip position). The second modification describes only differences from the embodiment and will not be repeated a description about the same contents as the embodiment. The same effect as the embodiment is ensured for a configuration that is common to the second modification and the embodiment.

As illustrated in FIG. 19, the tip positioning process starts and places the booklet against the positioning rollers 649*a* and 649*b* to complete the positioning (step ST301). The inlet conveying portion 620 then stops driving (step ST302). At this time, the tip positioning process using the positioning rollers 649*a* and 649*b* has positioned the booklet so that the fold end portion thereof is located between the upper pressing plate 633 and the lower pressing plate 631 as illustrated in FIG. 13A. Control skips step ST302 and proceeds to the next step when the tip positioning process using the positioning rollers 649*a* and 649*b* already stops driving the inlet conveying portion 620. As illustrated in FIG. 14B, the positioning rollers 649*a* and 649*b* retract from the booklet positioning position (step ST303).

The pressing unit driving motor SM5 lowers the pressing base 632. The booklet is held so as to be nipped between the upper pressing plate 633 and the lower pressing plate 631 (step ST304). The booklet is pressed in the thickness direction when the booklet is nipped between the upper pressing plate 633 and the lower pressing plate 631. The fold end portion is accordingly deformed so as to project in the conveying direction (direction of the pressing roller to be inserted). The booklet thickness is detected when the booklet has been held completely. At this time, the booklet is held so that the fold end portion thereof is positioned between the first holding surface 631*a* of the lower pressing plate 631 and the second holding surface 633*a* of the upper pressing plate 633. Specifically, the booklet thickness detecting sensor 681 detects the position of the upper pressing plate 633 that fixes the booklet. This measures the booklet thickness (step ST305). The booklet tip position is determined based on the measured booklet thickness. The pressing unit moving motor SM9 drives based on the tip position (step ST306).

For example, the pressing unit 630 is moved upstream in the conveying direction when the booklet tip position is determined to be near to the pressing roller (a large amount of projection). The pressing unit 630 is moved downstream in the conveying direction when the booklet tip position is determined to be far from the pressing roller (a small amount of projection). The pressing unit driving portion 627 is driven based on the booklet tip position (deformation amount) corresponding to the booklet thickness (sheet information).

After the booklet is held, it is determined the booklet tip position based on the thickness of the booklet that is held and projected. The booklet is moved together with the pressing unit 630 so that the pressing roller presses the booklet fold end portion at the predetermined position based on the tip position. The tip positioning process for the booklet terminates (step ST307) when the pressing unit moving motor SM9 has completely moved the pressing unit 630 (positioning operation).

The tip positioning process according to the other embodiment illustrated in FIG. 19 provides the following effects in addition to the effects of the above-described embodiment. In the copier 1000 according to the second modification, the pressing unit driving portion 627 moves the pressing unit 630 to control the tip position of the booklet fold end portion according to the booklet tip position (deformation amount) based on the booklet thickness (sheet information). The copier can ensure a predetermined distance between the pressing roller (positioning roller 649*a*, first pressing roller 650, or second pressing roller 651 according to the embodiment) and the tip position of the booklet fold end portion. The pressing roller can ensure a constant amount of pressing (collapse) at the fold end portion even when the tip position of the fold end portion varies with different amounts of fold end portion deformation. As a result, the pressing roller can always press booklets at a predetermined pressure. Fold end portions can be uniformly shaped. The quality of finished booklets can be ensured.

While there have been described specific preferred embodiments of the present invention, the invention is not limited thereto. The embodiments of the invention describe only preferred effects resulting from the invention. The effects of the invention are not limited to those described in the embodiments.

According to the embodiment, for example, the pressing unit driving portion 627 moves the pressing unit 630 to move a booklet according to the deformation amount at the tip of the booklet nipped between the upper pressing plate 633 and the lower pressing plate 631. Instead, the pressing roller may be moved. According to the embodiment, the saddle stitch binding portion 800 produces booklets each of which contains one to 25 sheets folded double. The invention is not limited thereto. The number of sheets per booklet may be appropriately modified depending on capabilities of the saddle stitch binding portion, for example.

The deforming process described in the embodiment is applied to booklets each of which contains 11 or more sheets folded double. The invention is not limited thereto. The number of sheets may be changed depending on the sheet basis weight or thickness (sheet rigidity) of a sheet to be deformed, for example.

According to the embodiment, the deforming process uses two types of pressing rollers having different heights corresponding to two cases based on thicknesses of booklets to be deformed. The invention is not limited thereto. For example, more types of pressing rollers may be used for more cases.

According to the second modification, the sensor senses a booklet thickness and the pressing unit 630 is moved based on the booklet thickness. The invention is not limited thereto. For example, the tip position at the booklet fold end portion may be determined based on the sheet information such as rigidity (e.g., basis weight, thickness, and the number of sheets) of sheets contained in a booklet.

According to the embodiment, the deforming process controlling portion 601 performs the deforming process. The invention is not limited thereto. The controlling portion 1100 may perform the deforming process.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-173728, filed Aug. 2, 2010, and No. 2011-156464, filed Jul. 15, 2011, which are hereby incorporated by reference herein in their entirety.

What is claimed is:

1. A sheet processing apparatus, comprising:

a conveying portion which conveys a folded sheet bundle with a fold end portion in the lead;

a sheet holding portion which nips to deform and hold the sheet bundle conveyed and stopped by the conveying portion;

a pressing portion which presses a tip of the fold end portion of the sheet bundle held by the sheet holding portion to deform the fold end portion into a square shape;

a moving portion which moves the sheet holding portion to or from the pressing portion in a conveying direction while the sheet holding portion holds the sheet bundle; and a controlling portion which controls the moving portion to move the sheet holding portion in the conveying direction so that a distance in the conveying direction between a pressing position where the pressing portion presses the tip of the fold end portion and a tip position of the fold end portion after the sheet holding portion deforms the fold end portion but before the pressing portion deforms the fold end portion, becomes a constant distance.

2. The sheet processing apparatus according to claim 1, further comprising:

a tip detecting portion which detects a position of the tip of the fold end portion held by the sheet holding portion, wherein the controlling portion determines the tip position of the fold end portion to be pressed by the pressing portion based on the position detected by the tip detecting portion.

3. The sheet processing apparatus according to claim 1, further comprising:

a sheet thickness detecting portion which detects a thickness of the sheet bundle held by the sheet holding portion, wherein the controlling portion determines the tip position of the fold end portion to be pressed by the pressing portion based on the thickness of the sheet bundle detected by sheet thickness detecting portion.

4. An image forming apparatus comprising:

an image forming portion which forms an image on a sheet; and a sheet processing apparatus which performs a deforming process to a sheet bundle folded in two containing a plurality of sheets each having an image formed by the image forming portion, the sheet processing apparatus including:

a conveying portion which conveys a folded sheet bundle with a fold end portion in the lead;

a sheet holding portion which nips to deform and hold the sheet bundle conveyed and stopped by the conveying portion;

a pressing portion which presses a tip of the fold end portion of the sheet bundle held by the sheet holding portion to deform the fold end portion into a square shape;

a moving portion which moves the sheet holding portion to or from the pressing portion in a conveying direction while the sheet holding portion holds the sheet bundle; and a controlling portion which controls the moving portion to move the sheet holding portion in the conveying direction so that a distance in the conveying direction between a pressing position where the pressing portion presses the tip of the fold end portion and a tip position of the fold end portion after the sheet holding portion deforms the fold end portion but before the pressing portion deforms the fold end portion, becomes a constant distance.

5. The image forming apparatus according to claim 4, wherein the sheet processing apparatus further includes a tip detecting portion which detects a position of the tip of the fold end portion held by the sheet holding portion, wherein the controlling portion determines the tip position of the fold end portion to be pressed by the pressing portion based on the position detected by the tip detecting portion.

6. The image forming apparatus according to claim 4, wherein the sheet processing apparatus further includes a sheet thickness detecting portion which detects a thickness of the sheet bundle held by the sheet holding portion, and the controlling portion determines the tip position of the fold end portion to be pressed by the pressing portion based on the thickness of the sheet bundle detected by sheet thickness detecting portion.

* * * * *